US006475715B2

(12) United States Patent
Hirai et al.

(10) Patent No.: US 6,475,715 B2
(45) Date of Patent: Nov. 5, 2002

(54) PHOTOTHERMOGRAPHIC MATERIAL AND IMAGE FORMING METHOD

(75) Inventors: Katsura Hirai, Hino (JP); Kiyoshi Fukusaka, Hino (JP)

(73) Assignee: Konica Corporation (JP)

( * ) Notice: Subject to any disclaimer, the term of this patent is extended or adjusted under 35 U.S.C. 154(b) by 0 days.

(21) Appl. No.: 09/814,476

(22) Filed: Feb. 13, 2001

(65) Prior Publication Data

US 2001/0024772 A1 Sep. 27, 2001

(30) Foreign Application Priority Data

Feb. 16, 2000 (JP) ..... 2000/038276
Feb. 22, 2000 (JP) ..... 2000/044358

(51) Int. Cl.[7] ..... G03C 1/498; G03C 1/34

(52) U.S. Cl. ..... 430/619; 430/607; 430/611; 430/613; 430/614; 430/626; 430/629

(58) Field of Search ..... 430/619, 626, 430/629, 611, 613, 614, 607

(56) References Cited

U.S. PATENT DOCUMENTS 4,835,096 A * 5/1989 Lea ..... 430/619
5,464,737 A * 11/1995 Sakizadeh et al. ..... 430/619
5,922,529 A 7/1999 Tsuzuki et al.
5,939,248 A * 8/1999 Kirk et al. ..... 430/619
6,297,001 B1 * 10/2001 Takiguchi et al. ..... 430/619
6,329,135 B1 * 12/2001 Kashiwagi ..... 430/619

* cited by examiner

*Primary Examiner*—Thorl Chea
(74) *Attorney, Agent, or Firm*—Bierman, Muserlian and Lucas

(57) ABSTRACT

A photothermographic material is disclosed, comprising on a support an organic silver salt, a light-sensitive silver halide, a reducing agent, and a compound represented by the following formula, 6-aryl-2,4-bis(tribromomethyl)-s-triazine or a 6-heteroaryl-2,4-bis(tribromomethyl)-s-triazine.

17 Claims, No Drawings

PHOTOTHERMOGRAPHIC MATERIAL AND IMAGE FORMING METHOD

FIELD OF THE INVENTION

The present invention relates to photothermographic materials forming images through thermal processing and an image forming method by the use thereof and in particular to a technique to improve fogging levels in image formation.

BACKGROUND OF THE INVENTION

In the field of medical treatment and graphic arts, there have been problems in working property with respect to effluents produced from wet-processing of image forming materials, and recently, reduction of the processing effluent is strongly demanded in terms of environment protection and space saving. Accordingly, there are needed techniques regarding photothermographic materials for photographic use and which are capable of forming black images exhibiting high sharpness, enabling efficient exposure by means of a laser imager or laser image setter. As such a technique is known a thermally developable photosensitive material, which comprises a support having thereon an organic silver salt, light-sensitive silver halide grains and a reducing agent, as described in U.S. Pat. Nos. 3,152,904 and 3,487,075; and D. Morgan "Dry Silver Photographic Material" (Handbook of Imaging Materials, Marcel Dekker, Inc., page 48, 1991). These photosensitive materials are developed at a temperature of not less than 80° C. and called a photothermographic material.

Such a photothermographic material usually comprises a reducible silver source (e.g., organic silver salt), a catalytically active amount of photocatalyst (e.g., silver halide) and a reducing agent which are dispersed in an organic binder matrix. The photothermographic materials are stable at ordinary temperature and forms silver upon heating, after exposure, at a relatively high temperature (e.g., 80° C. or higher) through an oxidation-reduction reaction between the reducible silver source (which functions as an oxidizing agent) and the reducing agent. The oxidation-reduction reaction is accelerated by catalytic action of a latent image produced by exposure. Silver formed through reaction of the reducible silver salt in exposed areas provides a black image, which contrasts with non-exposes areas, leading to image formation.

One disadvantage of the photothermographic materials is that silver is undesirably formed in the white background of unexposed areas, resulting in fog. There have been proposed various techniques to restrain such fogging, as disclosed in U.S. Pat. Nos. 3,874,946, 4,459,350, 5,340,712, 4,756,999, 5,594,143; JP-A Nos. 58-59439, 59-46641 and 59-57233 (hereinafter, the term, JP-A refers to a unexamined, published Japanese Patent Application). JP-A No. 6-208193 discloses a photothermographic emulsion containing an isocyanate group-including compound in combination with a halogenated anti-foggant, as a means for improving storage stability with respect to fogging.

However, such a technique was not sufficient in an anti-fogging effect, or even if an anti-fogging effect was sufficient, there were problems such that reduction in sensitivity was caused. There was also a problem that an increased fogging or variation in sensitivity occur during storage of the photothermographic material. Further, there were problems that when a processed photothermographic material was exposed to room light or viewing box light, an increase of fogging (so-called printing-out), variation in printing-out density during exposure and deterioration in image color due to printing-out occurred and storage stability of images was insufficient levels. Furthermore, when developer at a higher temperature to accelerate development, fogging was disadvantageously increased. There is desired development of an antifoggant without such problems.

SUMMARY OF THE INVENTION

Accordingly, it is an object of the present invention to provide a photothermographic material exhibiting enhanced sensitivity without causing increased fogging, lowered fogging, reduced variation in sensitivity or minimized deterioration in image color during storage, superior image stability, and improvements in disadvantageous fogging caused by development at a higher temperature.

The object of the invention can be accomplished by the following constitution:

(1) a photothermographic material comprising on a support a) an organic silver salt, b) light-sensitive silver halide, c) a reducing agent and d) a compound represented by formula (1), 6-aryl-2,4-bis(tribromomethyl)-s-triazine or a 6-heteroaryl-2,4-bis(tribromomethyl)-s-triazine:

formula (1)

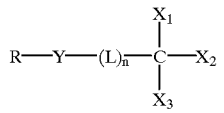

wherein $X_1$, $X_2$ and $X_3$ each represent a hydrogen atom or a substituent group, provided that at least one of $X_1$, $X_2$ and $X_3$ is a halogen atom; L represents a sulfonyl group, a carbonyl group or a sulfinyl group; when L is a carbonyl group or sulfinyl group, n is 1, 2 or 3 and when L is a sulfonyl group, n is 0, 1, 2 or 3; when L is a carbonyl group or a sulfinyl group or when n is 2 or 3 and L is a sulfonyl group, Y represents a single bond, —N($R_1$)—, an oxygen atom, a sulfur atom, a selenium atom, or —($R_2$)C=C($R_3$)—, and when n is 0 or 1 and L is a sulfonyl group, Y represents —N($R_1$)—, an oxygen atom, a sulfur atom, a selenium atom, or —($R_2$)C=C($R_3$)—, in which $R_1$, $R_2$ and $R_3$ each represent a hydrogen atom or a substituent group; R represents a hydrogen atom, a halogen atom or a substituted or unsubstituted aliphatic group, provided that $R_1$ and R, or $R_3$ and R may combine with each other to form an alicyclic ring.

DETAILED DESCRIPTION OF THE INVENTION

The compound represented by formula (1) will be described:

formula (1)

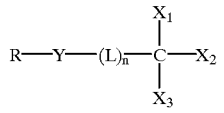

wherein $X_1$, $X_2$ and $X_3$ each represent a hydrogen atom or a substituent group, provided that at least one of $X_1$, $X_2$ and $X_3$ is a halogen atom; L represents a sulfonyl group, a carbonyl group or a sulfinyl group; when L is a carbonyl group or sulfinyl group, n is 1, 2 or 3 and when L is a sulfonyl group, n is 0, 1, 2 or 3; when L is a carbonyl group or a sulfinyl group or when n is 2 or 3 and L is a sulfonyl group, Y represents a single bond, —N($R_1$)—, an oxygen atom, a sulfur atom, a selenium atom, or —($R_2$)C=C($R_3$)—, and when n is 0 or 1 and L is a sulfonyl group, Y represents —N($R_1$)—, an oxygen atom, a sulfur atom, a selenium atom, or —($R_2$)C=C($R_3$)—, in which $R_1$, $R_2$ and $R_3$ each represent a hydrogen atom or a substituent group; R represents a hydrogen atom, a halogen atom or a substituted or unsubstituted aliphatic group, provided that $R_1$ and R, or $R_3$ and R may combine with each other to form an alicyclic ring.

In formula (1), $X_1$, $X_2$ and $X_3$ each represent a hydrogen atom or a substituent group, provided that at least one of $X_1$, $X_2$ and $X_3$ is a halogen atom. The halogen atom is F, Cl, Br or I, and in cases of two or more halogen atoms, the halogen atoms may be the same or different. The halogen atom is preferably Cl or Br, and more preferably Br.

Substituent groups other than a halogen atom may be any one, including an alkyl group, an alkenyl group, an aryl group, an alkoxy group, an acyl group, an alkoxycarbonyl group, an aryloxy group, an aryloxycarbonyl group, a carbamoyl group, a sulfamoyl group, an acyoxy group, an acylamino group, an alkoxycarbonylamino group, an aryloxycarbonylamino group, a sulfonylamino group, a ureido group, a phosphoric acid amido group, a sulfinyl group, hydroxy, and a heterocyclic group. Of these groups, electron-withdrawing group, i.e., a trihalomethyl group, an acyl group, an alkoxycarbonyl group, an aryloxycarbonyl group, a carbamoyl group or a sulfamoyl group is preferred. It is more preferred that all of $X_1$, $X_2$ and $X_3$ are halogen atoms, and it is still more preferred that $X_1$, $X_2$ and $X_3$ are or Br.

R is a hydrogen atom, a halogen atom or a substituted or unsubstituted aliphatic group, and preferably an alkyl group.

$R_1$, $R_2$ and $R_3$ are each a hydrogen atom or a substituent group, and preferably —N($R_1$)—, an oxygen atom or a vinyl group and when Y is —N($R_1$)—, $R_1$ is preferably an alkyl group.

Alternatively, the compound of formula (1) may be represented by formula (1*a*), (1*b*) or (1*c*):

formula (1a)

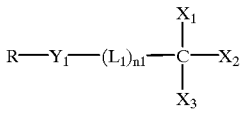

wherein $X_1$, $X_2$ and $X_3$ each represent a hydrogen atom or a substituent group, provided that at least one of $X_1$, $X_2$ and $X_3$ is a halogen atom; $L_1$ represents a sulfonyl group; n1 is 0 or 1; $Y_1$ represents —N($R_1$)—, an oxygen atom, a sulfur atom, a selenium atom, or —($R_2$)C=C($R_3$)—, in which $R_1$, $R_2$ and $R_3$ each represent a hydrogen atom or a substituent group; R represents a hydrogen atom, a halogen atom or a substituted or unsubstituted aliphatic group, $R_1$ and R, or $R_3$ and R may combine with each other to form an alicyclic ring;

formula (1b)

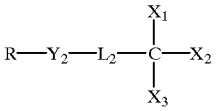

wherein $X_1$, $X_2$ and $X_3$ each represent a hydrogen atom or a substituent group, provided that at least one of $X_1$, $X_2$ and $X_3$ is a halogen atom; $L_2$ represents a carbonyl group or a sulfinyl group; $Y_2$ represents —N($R_1$)—, an oxygen atom, a sulfur atom, a selenium atom, or —($R_2$)C=C($R_3$)—, in which $R_1$, $R_2$ and $R_3$ each represent a hydrogen atom or a substituent group; R represents a hydrogen atom, a halogen atom or a substituted or unsubstituted aliphatic group, $R_1$ and R, or $R_3$ and R may combine with each other to form an alicyclic ring.

In formula (1a) or (1b), $X_1$, $X_2$ and $X_3$ each represent the same as defined in formula (1).

$Y_1$ and $Y_2$ each represent —N($R_1$)—, an oxygen atom, a sulfur atom, a selenium atom, or —($R_2$)C=C($R_3$)—, and $Y_2$ also represents a single bond. $R_1$, $R_2$ and $R_3$ each represent a hydrogen atom or a substituent group, and preferably —N($R_1$)—, an oxygen atom or a vinyl group. In the case of $Y_1$ being —N($R_1$)—, $R_1$ is preferably an alkyl group, and still more preferably, R and $R_1$ are both an alicyclic griup.

R is a hydrogen atom, a halogen atom or a substituted or unsubstituted aliphatic group, and preferably an alkyl group.

$L_1$ is a sulfonyl group, and $L_2$ is a carbonyl or sulfinyl group. $L_1$ of a sulfonyl group is more preferred than $L_2$ of a carbonyl or sulfinyl group. n1 is 0 or 1, and more preferably 1.

Next, the compound represented by formula (1c) is represented by the following formula (1c):

formula (1c)

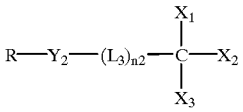

wherein $X_1$, $X_2$ and $X_3$ each represent a hydrogen atom or a substituent group, provided that at least one of $X_1$, $X_2$ and $X_3$ is a halogen atom; $L_3$ represents a sulfonyl, a carbonyl or a sulfinyl group; n2 is 2 or 3; $Y_2$ represents a single bond, —N($R_1$)—, an oxygen atom, a sulfur atom, a selenium atom, or —($R_2$)C=C($R_3$)—, in which $R_1$, $R_2$ and $R_3$ each represent a hydrogen atom or a substituent group; R represents a hydrogen atom, a halogen atom or a substituted or unsubstituted aliphatic group, $R_1$ and R, or $R_3$ and R may combine with each other to form an alicyclic ring.

In formula (1c), $X_1$, $X_2$, $X_3$ and R are the same as defined in formulas (1a) and (1b); $Y_2$ is the same as defined in formula (1b), and preferably —N($R_1$)—, an oxygen atom or a vinyl group. In the case of $Y_2$ being —N($R_1$)—, $R_1$ is preferably an alkyl group, and more preferably, R and $R_1$ form an alicyclic ring. $L_3$ is a sulfonyl group, a carbonyl group or a sulfinyl group, and preferably a sulfinyl group. n2 is 2 or 3, and preferably 2.

The halogen-containing compound represented by formula (1), (1a), (1b) or (1c) preferably contains a ballast group. The ballast group a substituent group having a total carbon atoms of 8 or more, preferably 8 to 100, more preferably 8 to 60, and still more preferably 10 to 40. The ballast group is preferably an aliphatic hydrocarbon group (e.g., an alkyl group, alkyl group, alkynyl group), an aryl group, a heterocyclic group, or a combination of these groups through an ether group, thioether group, carbonyl group, amino group, sulfonyl group or phosphonyl group. Alternatively, the ballast group may be a polymer. Exemplary examples of the ballast groups are described, for example, in Research Disclosure 1995/2, 37938 page 82-89; JP-A Nos. 1-280747 and 1-283548. The ballast group is preferably one having a total carbon atoms of 7 to 50, and more preferably 10 to 30. This ballast may be provided as a substituent group represented by $R_1$, $R_2$ or $R_3$ of —N($R_1$)— or —($R_2$)C═C($R_3$)— represented by $Y_1$ or $Y_2$, as an aliphatic group represented by R or as a substituent group represented by $X_1$, $X_2$ or $X_3$—in formulas (1a) to (1c).

Examples of the compounds represented by formula (1) or formulas (1a), (1b) and (1c) are shown below but are not limited to these.

1a-1

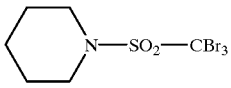

1a-2

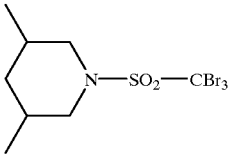

1a-3

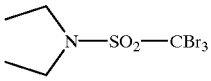

1a-4

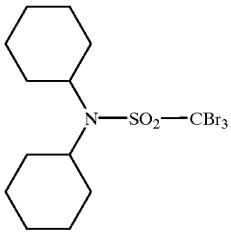

1a-5

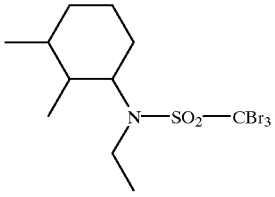

1a-6

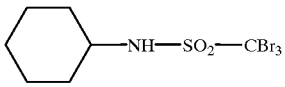

1a-7

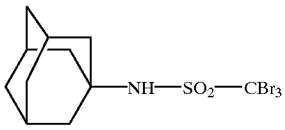

-continued 1a-8

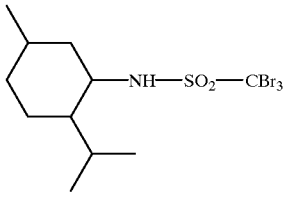

1a-9

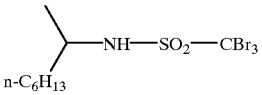

1a-10

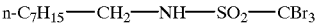

1a-11

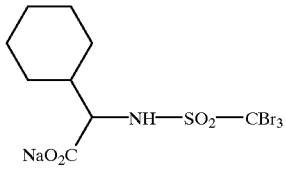

1a-12

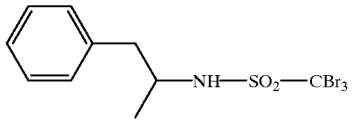

1a-13

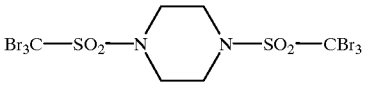

1a-14

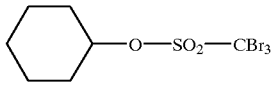

1a-15

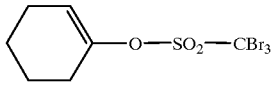

1a-16

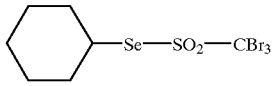

1a-17

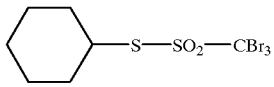

1a-18

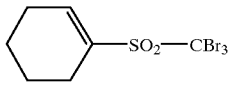

1a-19

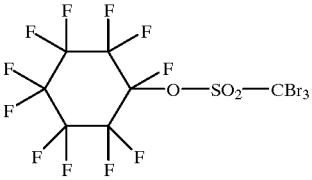

-continued
1a-20
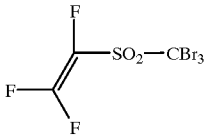
1a-21
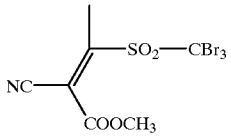
1a-22
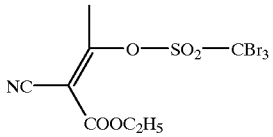
1a-23
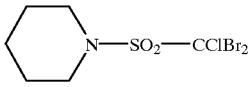
1a-24
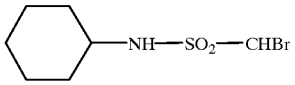
1a-25
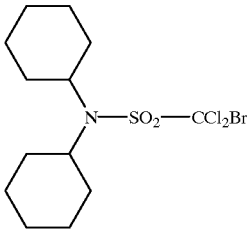
1a-26
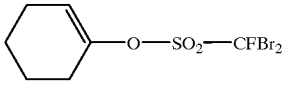
1a-27
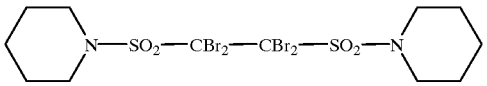
1a-28
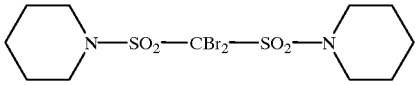
1b-1
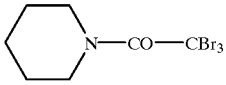
1b-2
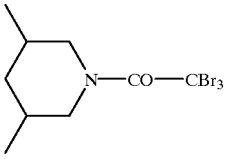
-continued
1b-3
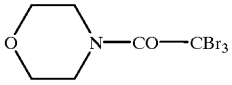
1b-4
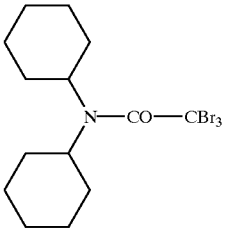
1b-5
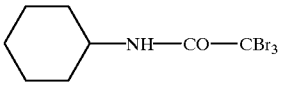
1b-6
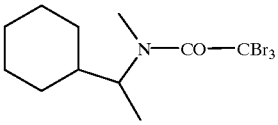
1b-7
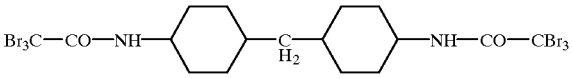
1b-8
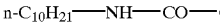
1b-9
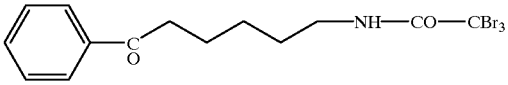
1b-10
1b-11
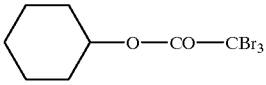
1b-12
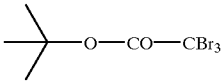
1b-13
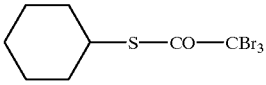
1b-14
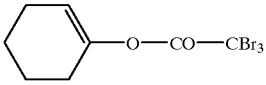
1b-15
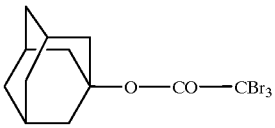

-continued 1b-16

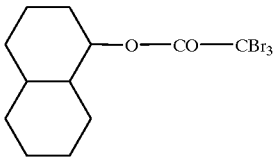

1b-17

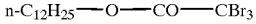

1b-18

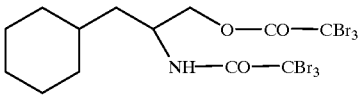

1b-19

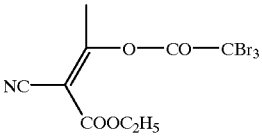

1b-20

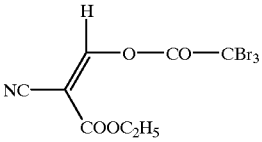

1b-21

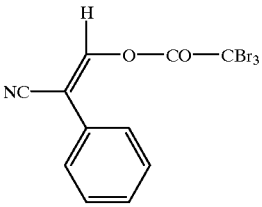

1b-22

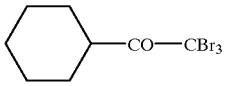

1b-23

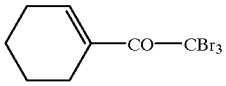

1b-24

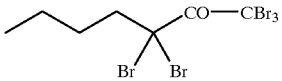

1b-25

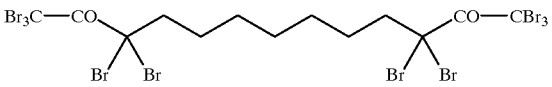

1b-26

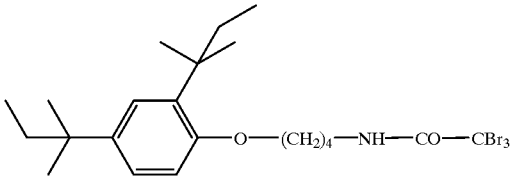

-continued 1b-27

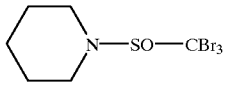

1b-28

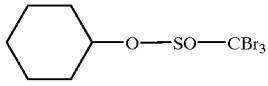

1b-29

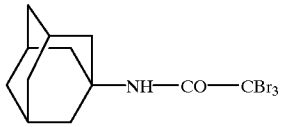

1b-30

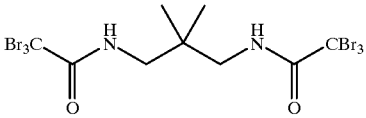

1c-1

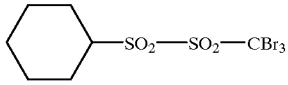

1c-2

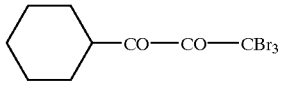

1c-3

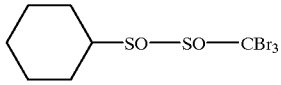

The compound of formula (1) or formula (1a), (1b) or (1c) is preferably contained in the light-sensitive layer, in an amount of $10^{-5}$ to 1 mol, and more preferably $10^{-4}$ to $10^{-2}$ mol per mol of the total silver content in silver halide and organic silver salt.

The compounds of formula (1) formulas (1a) to (1c) can be synthesized according to the commonly known method, for example, as described in U.S. Pat. No. 3,892,743. Next, synthesis examples of the halogen-containing compound are described below.

Synthesis of Exemplified Compound (1a-1)

The compound was synthesized according to the method described in U.S. Pat. No. 3,892,743.

Synthesis of Exemplified Compound (1a-14)

To 2.1 g of cyclohexanemethansulfonate were successively added 50 ml of glacial acetic acid and 12.0 g of sodium acetate and 11.7 g of bromine was further dropwise added thereto, while stirring at room temperature. After completing addition, the mixture was further stirred at 100° C. for a period of 5 hrs., then, the reaction mixture was cooled to room temperature and 250 ml of water was added thereto. Precipitated crystals were filtered and purified by means of silica gel chromatography (yield: 1.2 g, 25%).

Synthesis of Exemplified Compound (1b-1)

To 1.8 g of piperidine was added 10 ml of toluene and cooled in an ice bath. Then, 3.1 g of tribromoacetyl chloride dissolved in 10 ml of toluene was dropwise added with cooling. After completing addition, the reaction mixture was further stirred for 2 hrs., then, allowed to return to room temperature and 50 ml of aqueous 10% sodium hydrogen carbonate solution was added thereto. The mixture was subjected to extraction with 50 ml of ethyl acetate and the ethyl acetate layer was successively washed with 50 ml of 1 mol/l hydrochloric acid and 50 ml of aqueous 25% sodium chloride solution, and then was dried on magnesium sulfate. After filtration, the reaction product was concentrated under reduced pressure. Obtained solids were recrystalized in 50 ml of n-hexane to obtain exemplified compound (1b-1), yield: 2.8 g, 80%.

The triazine compounds used in this invention is preferably represented by the following formula (1):

formula (TZ)

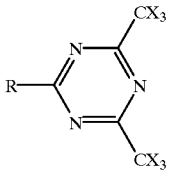

wherein $X_3$ is a halogen atom, preferably Cl or Br, and more preferably Br; R an alkyl group, an alkenyl group, an alkynyl group, an aryl group, a heteroaryl group, or a group formed by the combination of these groups with an ether group, thioether group, carbonyl group, thiocarbonyl group, amino group, sulfonyl group, sulfoxyl group, phosphonyl group or amido group. R is preferably an aryl group or a heteroaryl group, which may be substituted with any substituent group such as an electron-withdrawing group or an electron-donating group. R is more preferably phenyl group or a substituted phenyl group. The absorption maximum is preferably at the wavelengths of 250 to 370 nm. When the absorption maximum is at the wavelength of more than 370 nm, variation in density caused by printing-out is marked and image stability after being printed-out is deteriorated.

Synthesis of the foregoing triazine compound is described in J.O. C 29, 1527 (1964) or Bull. Chem. Soc. JPN. 42, 2924 (1969).

Examples of the triazine compounds are shown below.

TZ-001

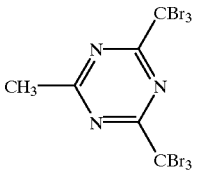

TZ-002

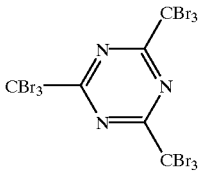

TZ-003

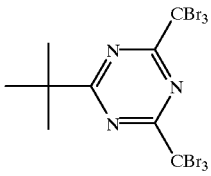

-continued

TZ-004

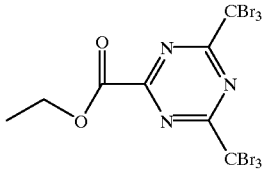

TZ-005

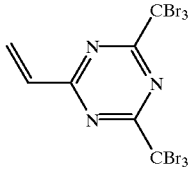

TZ-006

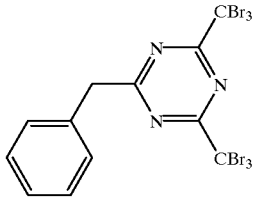

TZ-007

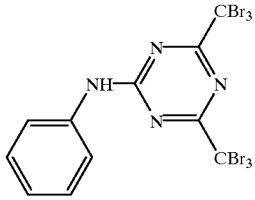

TZ-008

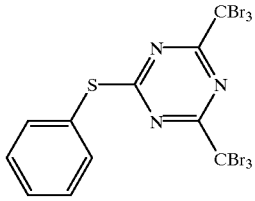

TZ-009

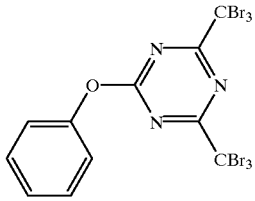

TZ-010

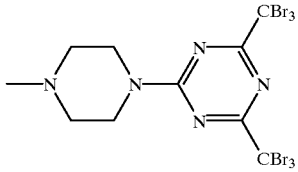

TZ-011

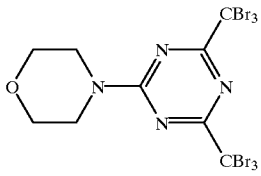

-continued

TZ-012

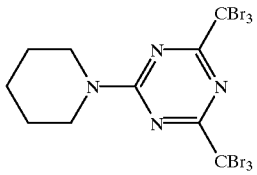

TZ-013

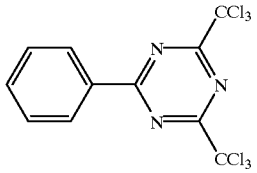

TZ-014

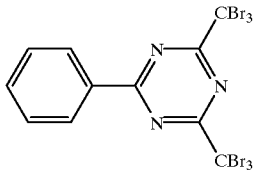

TZ-015

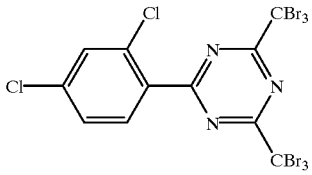

TZ-016

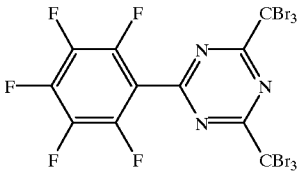

TZ-017

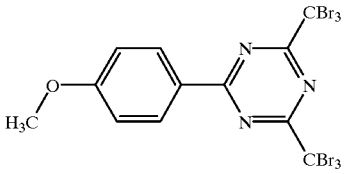

TZ-018

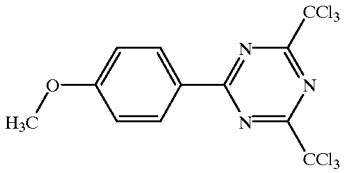

TZ-019

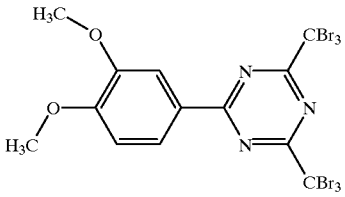

-continued

TZ-020

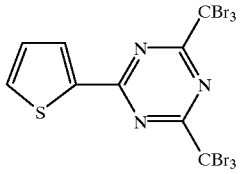

TZ-021

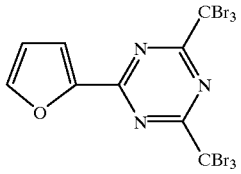

TZ-022

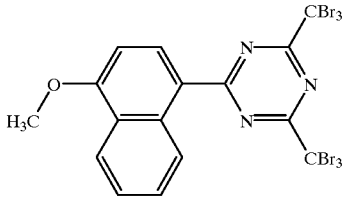

TZ-023

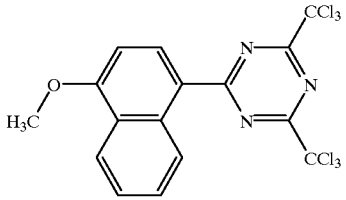

TZ-024

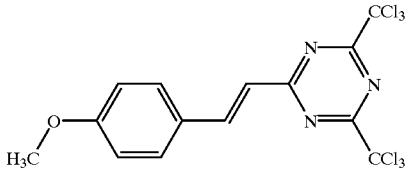

TZ-025

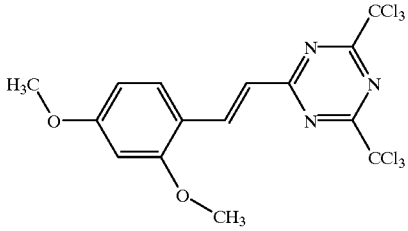

The photothermographic material of this invention preferably contains an isocyanate compound to enhance effects of this invention.

The isocyanate compounds usable in this invention include those represented by the following formula (2):

formula (2)

$$O{=}C{=}{-}N{-}L^1{-}(N{=}C{=}O)_v$$

wherein v is an integer of 0 to 10, and preferably 2 to 4; $L^1$ is a linkage group such as an alkylene group, an alkenylene group, an arylenes group or an alkylarylene group.

In the compounds represented by formula (2), the aryl ring of the arylenes group may be substituted. Preferred examples of the substituent group include a halogen atom (e.g., bromine or chlorine atom), hydroxy group, amino group, carboxy group, an alkyl group and alkoxy group.

The isocyanate compound is an isocyanate compound containing at least two isocyanate group and its adduct. Examples thereof include aliphatic isocyanates, alicyclic isocyanates, benzeneisocyanates, naphthalenediisocyanates, biphenyldiisocyanates, diphenylmethandiisocyanates, triphenylmethanediisocyanates, triisocyanates, tetraisocyanates, their adducts and adducts of these isocyanates and bivalent or trivalent polyhydric alcohols.

Exemplary examples of isocyanate compounds include: ethanediisocyanate, butanediisocyanate, hexanediisocyanate, 2,2-dimetylpentanediisocyanate, 2,2,4-trimethylpentanediisocyanate, decanediisocyanate, ω, ω'-diisocyanate-1,3-dimethylbenzol, ω, ω'-diisocyanate-1, 2-dimethylcyclohexanediisocyanate, ω, ω'-diisocyanate-1, 4-diethylbenzol, , ω, ω'-diisocyanate-1,5-dimethylnaphthalene, ω, ω'-diisocyanate-n-propypbiphenyl, 1,3-phenylenediisocyanate, 1-methylbenzol-2,4-diisocyanate, 1,3-dimethylbenzol-2,6-diisocyanate, naphthalene-1,4-diisocyanate, 1,1'-naphthyl-2,2'-diisocyanate, biphenyl-2,4'-diisocyanate, 3,3'-dimethylbiphenyl-4,4'-diisocyanate, diphenylmethane-4,4'-diisocyanate, 2,2'-dimethyldiphenylmethane-4,4'-diisocyanate, 3,3'-dimethoxydiphenylmethane-4,4'-diisocyanate, 4,4'-diethoxydiphenylmethane-4,4'-diisocyanate, 1-methylbenzol-2,4,6-triisocyanate, 1,3,5-trimethylbenzene-2,4,6-triisocyanate, diphenylmethane-2,4,4'-triisocyanate, triphenylmethane-4,4',4'-triisocyanate, tolylenediisocyanate, 1,5-naphthylenediisocyanate; dimmer or trimer adducts of these isocyanate compounds (e.g., adduct of 2-mole hexamethylenediisocyanate, adduct of 3 mole hexamethylenediisicyanate, adduct of 2 mole 2,4-tolylenediisocyanate, adduct of 3 mole 2,4-tolylenediisocyanate); adducts of two different isocyanates selected from these isocyanate compounds described above; and adducts of these isocyanate compounds and bivalent or trivalent polyhydric alcohol (preferably having up to 20 carbon atoms, such as ethylene glycol, propylene glycol, pinacol, and trimethylol propane), such as adduct of tolylenediisocyanate and trimethylolpropane, or adduct of hexamethylenediisocyanate and trimethylolpropane. Of these, a trimer of hexamethylenediisocyanate (1,3,5-triisocyanato-hexylcyanuric acid) is specifically preferred.

These polyisocyanate compounds may be incorporated into any portion of the photothermographic material, for example, into the interior of a support (e.g., into size of a paper support) or any layer on the photosensitive layer-side of the support, such as a photosensitive layer, surface protective layer, interlayer, antihalation layer or sublayer. Thus it may be incorporated into one or plurality of these layers. The isocyanate compounds described above are used preferably in an amount of 0.01 to 20% by weight, and more preferably 0.5 to 5% by weight, based on the weight of the light-sensitive layer.

Examples of commercially available isocyanate compounds are shown below, including aliphatic isocyanates, aromatic isocyanates and polymeric isocyanates but are by no means limited to these:

IC-1 Desmodur N100, aliphatic isocyanate, available from Movey Corp.

IC-2 Desmodur N3300, aliphatic isocyanate, available from Movey Corp.

IC-3 Mondur TD-80, aromatic isocyanate, available from Movey Corp.

IC-4 Mondur M, aromatic isocyanate, available from Movey Corp.

IC-5 Mondur MRS, aromatic isocyanate, available from Movey Corp.

IC-6 Desmodur W, aliphatic isocyanate, available from Movey Corp.

IC-7 Papi 27 polymeric isocyanate, available from Movey Corp.

IC-8 Isocyanate Y1890 aliphatic isocyanate, available from Huels.

IC-9 Octadecylisocyanate, aliphatic isocyanate, available from Aldrich Corp.

Silver halide grains of photosensitive silver halide in the present invention work as a light sensor. In order to minimize cloudiness after image formation and to obtain excellent image quality, the less the average grain size, the more preferred, and the average grain size is preferably less than 0.1 μm, more preferably between 0.01 and 0.1 μm, and still more preferably between 0.02 and 0.08 μm. The average grain size as described herein is defined as an average edge length of silver halide grains, in cases where they are so-called regular crystals in the form of cube or octahedron. Furthermore, in cases where grains are not regular crystals, for example, spherical, cylindrical, and tabular grains, the grain size refers to the diameter of a sphere having the same volume as the silver grain. Furthermore, silver halide grains are preferably monodisperse grains. The monodisperse grains as described herein refer to grains having a variation coefficient of grain size distribution, obtained by the formula described below of less than 40%; more preferably less than 30%, and most preferably from 0.1 to 20%.

Variation coefficient of grain size distribution=(standard deviation of grain diameter)/(average grain diameter)×100 (%)

The silver halide grain shape is not specifically limited, but a high ratio accounted for by a Miller index [100] plane is preferred. This ratio is preferably at least 50%; is more preferably at least 70%, and is most preferably at least 80%. The ratio accounted for by the Miller index [100] face can be obtained based on T. Tani, J. Imaging Sci., 29, 165 (1985) in which adsorption dependency of a [111] face or a [100] face is utilized.

Furthermore, another preferred silver halide shape is a tabular grain. The tabular grain as described herein is a grain having an aspect ratio represented by r/h of at least 3, wherein r represents a grain diameter in μm defined as the square root of the projection area, and h represents thickness in μm in the vertical direction. Of these, the aspect ratio is preferably between 3 and 50. The grain diameter is preferably not more than 0.1 μm, and is more preferably between 0.01 and 0.08 μm. These are described in U.S. Pat. Nos. 5,264,337, 5,314,789, 5,320,958, and others. In the present invention, when these tabular grains are used, image sharpness is further improved. The composition of silver halide may be any of silver chloride, silver chlorobromide, silver iodochlorobromide, silver bromide, silver iodobromide, or silver iodide.

Silver halide emulsions used in the invention can be prepared according to the methods described in P. Glafkides, Chimie Physique Photographique (published by Paul Montel Corp., 19679; G. F. Duffin, Photographic Emulsion Chemistry (published by Focal Press, 1966); V. L. Zelikman et al., Making and Coating of Photographic Emulsion (published by Focal Press, 1964). Any one of acidic precipitation, neutral precipitation and ammoniacal precipitation is applicable and the reaction mode of aqueous soluble silver salt and halide salt includes single jet addition, double jet addition and a combination thereof.

Silver halide preferably occludes ions of metals belonging to Groups 6 to 11 of the Periodic Table. Preferred as the metals are W, Fe, Co, Ni, Cu, Ru, Rh, Pd, Re, Os, Ir, Pt and Au. These metals may be introduced into silver halide in the form of a complex. In the present invention, regarding the transition metal complexes, six-coordinate complexes represented by the general formula described below are preferred:

Formula: $(ML_6)^m$:

wherein M represents a transition metal selected from elements in Groups 6 to 11 of the Periodic Table; L represents a coordinating ligand; and m represents 0, 1−, 2−, 3−or 4−. Exemplary examples of the ligand represented by L include halides (fluoride, chloride, bromide, and iodide), cyanide, cyanato, thiocyanato, selenocyanato, tellurocyanato, azido and aquo, nitrosyl, thionitrosyl, etc., of which aquo, nitrosyl and thionitrosyl are preferred. When the aquo ligand is present, one or two ligands are preferably coordinated. L may be the same or different. Particularly preferred examples of M include rhodium (Rh), ruthenium (Ru), rhenium (Re), iridium (Ir) and osmium (Os).

Exemplary examples of transition metal ligand complexes are shown below.

1: $[RhCl_6]^{3-}$
2: $[RuCl_6]^{3-}$
3: $[ReCl_6]^{3-}$
4: $[RuBr_6]^{3-}$
5: $[OsCl_6]^{3-}$
6: $[IrCl_6]^{4-}$
7: $[Ru(NO)Cl_5]^{2-}$
8: $[RuBr_4(H_2O)]^{2-}$
9: $[Ru(NO)(H_2O)Cl_4]^{-}$
10: $[RhCl_5(H_2O)]^{2-}$
11: $[Re(NO)Cl_5]^{2-}$
12: $[Re(NO)(CN)_5]^{2-}$
13: $[Re(NO)Cl(CN)_4]^{2-}$
14: $[Rh(NO)2Cl_4]^{-}$
15: $[Rh(NO)(H_2O)Cl_4]^{-}$
16: $[Ru(NO)(CN)_5]^{2-}$
17: $[Fe(CN)_6]^{3-}$
18: $[Rh(NS)Cl_5]^{2-}$
19: $[Os(NO)Cl_5]^{2-}$
20: $[Cr(NO)Cl_5]^{2-}$
21: $[Re(NO)Cl_5]^{-}$
22: $[Os(NS)Cl_4(TeCN)]^{2-}$
23: $[Ru(NS)Cl_5]^{2-}$
24: $[Re(NS)Cl_4(SeCN)]^{2-}$
25: $[Os(NS)Cl(SCN)_4]^{2-}$
26: $[Ir(NO)Cl_5]^{2-}$
27: $[Ir(NS)Cl_5]^{2-}$

One type of these metal ions or complex ions may be employed and the same type of metals or the different type of metals may be employed in combinations of two or more types. Generally, the content of these metal ions or complex ions is suitably between $1\times10^{-9}$ and $1\times10^{-2}$ mole per mole of silver halide, and is preferably between $1\times10^{-8}$ and $1\times10^{-4}$ mole.

Compounds, which provide these metal ions or complex ions, are preferably incorporated into silver halide grains through addition during the silver halide grain formation. These may be added during any preparation stage of the silver halide grains, that is, before or after nuclei formation, growth, physical ripening, and chemical ripening. However, these are preferably added at the stage of nuclei formation, growth, and physical ripening; furthermore, are preferably added at the stage of nuclei formation and growth; and are most preferably added at the stage of nuclei formation. These compounds may be added several times by dividing the added amount. Uniform content in the interior of a silver halide grain can be carried out. As disclosed in JP-A No. 63-29603, 2-306236, 3-167545, 4-76534, 6-110146, 5-273683, the metal can be non-uniformly occluded in the interior of the grain.

These metal compounds can be dissolved in water or a suitable organic solvent (for example, alcohols, ethers, glycols, ketones, esters, amides, etc.) and then added. Furthermore, there are methods in which, for example, an aqueous metal compound powder solution or an aqueous solution in which a metal compound is dissolved along with NaCl and KCl is added to a water-soluble silver salt solution during grain formation or to a water-soluble halide solution; when a silver salt solution and a halide solution are simultaneously added, a metal compound is added as a third solution to form silver halide grains, while simultaneously mixing three solutions; during grain formation, an aqueous solution comprising the necessary amount of a metal compound is placed in a reaction vessel; or during silver halide preparation, dissolution is carried out by the addition of other silver halide grains previously doped with metal ions or complex ions. Specifically, the preferred method is one in which an aqueous metal compound powder solution or an aqueous solution in which a metal compound is dissolved along with NaCl and KCl is added to a water-soluble halide solution. When the addition is carried out onto grain surfaces, an aqueous solution comprising the necessary amount of a metal compound can be placed in a reaction vessel immediately after grain formation, or during physical ripening or at the completion thereof or during chemical ripening.

Silver halide grain emulsions used in this invention may be desalted after the grain formation, using the methods known in the art, such as the noodle washing method and flocculation process.

The light-sensitive silver halide grains used in this invention is preferably subjected to a chemical sensitization. As preferable chemical sensitizations, well known chemical sensitizations in this art such as a sulfur sensitization, a selenium sensitization and a tellurium sensitization are usable. Furthermore, a noble metal sensitization using gold, platinum, palladium and iridium compounds and a reduction sensitization are available. As the compounds preferably used in the sulfur sensitization, the selenium sensitization and the tellurium sensitization, well known compounds can be used and the compounds described in JP-A 7-128768 is usable. Examples of the compounds used in the noble metal sensitization include chloroauric acid, potassium chloroaurate, potassium aurothiocyanate, gold sulfide, gold selenide, compounds described U.S. Pat. No. 2,448,060 and British Patent No. 618,061. Examples of the compounds used in the reduction sensitization include ascorbic acid, thiourea dioxide, stannous chloride, aminoiminomethanesulfinic acid, hydrazine derivatives, borane compounds, silane compounds and polyamine compounds. The reduction sensitization can be carried out by ripening an emulsion with keeping the pH and pAg at not less than 7 and not more than 8.3, respectively. Furthermore, the reduction sensitization can be carried out by introducing a silver ion alone at a time during the grain formation.

Sensitizing dyes are applicable to the light-sensitive layer of photothermographic materials used in this invention, including those which are described in JP-A 63-159841, 60-140335, 63-231437, 63-259651, 63-304242, 63-15245; U.S. Pat. Nos. 4,639,414, 4,740,455, 4,741,966, 4,751,175 and 4,835,096. Further, sensitizing dyes usable in this invention are described in Research Disclosure item 17643, IV-A, page 23 (December, 1978) and references cited therein. Sensitizing dyes exhibiting spectral sensitivity specifically suitable for spectral characteristics of various scanner light sources can be advantageously selected. There can be selected, for example, simple merocyanines described in JP-A No. 60-162247 and 2-48635, U.S. Pat. No. 2,161,331, German Patent No. 936,071, and Japanese Patent Application No. 3-189532, which are suitable for an argon ion laser light source; three-nuclei cyanine dyes described in JP-A No. 50-62425, 54-18726, 59-102229 and merocyanine dyes described in Japanese Patent Application No. 6-103272, which are suitable for a helium-neon laser light source; thiacarbocyanine dyes described in JP-B No. 48-42172, 51-9609, 55-39818 (hereinafter, the term, JP-B refers to published Japanese Patent), JP-A No. 62-284343 and 2-105135, which are suitable for LED light source and infrared semiconductor laser light source; tricarbocyanine dyes described in JP-A No. 59-191032 and 60-80841 and 4-quinoline nucleus-containing dicarbocyanine dyes described in JP-A 59-192242 and 3-67242 [formulas (IIIa) and (IIIb)], which are suitable for an infrared semiconductor laser light source. Further, sensitizing dyes described in JP-A No. 4-182639, 5-341432, JP-B No. 6-52387, 3-10931, U.S. Pat. No. 5,441,866 and JP-A 7-13295 are also emplyed to respond to infrared laser light of not less than 750 nm, preferably not less than 800 nm. These sensitizing dyes may be used alone or in combination thereof. The combined use of sensitizing dyes is often employed for the purpose of supersensitization. A super-sensitizing compound, such as a dye which does not exhibit spectral sensitization or substance which does not substantially absorb visible light may be incorporated, in combination with a sensitizing dye, into the emulsion.

In cases when being super-sensitized, and specifically when a reducing agent is not deactivated, photosensitivity is enhanced, print-out is easily promoted after development. In such a case, the present invention is effective. In cases when being infrared-sensitized, an infrared sensitizing dye has an oxidation-reduction potential at which a silver halide or an organic silver salt is slightly reducible, easily producing a silver cluster forming fog silver in the presence of the reducing agent, even when placed in a dark room. The produced silver cluster also induces fogging as a catalyst nucleus, deteriorating storage stability in the dark room or promoting print-out when placed in a daylight room after development. Further, sensitivity of the infrared sensitive material extends to the thermal radiation region outside the visible region so that the present invention is effective for inhibiting print-out silver produced by thermal radiation. Such a effect is marked in infrared-sensitized photosensitive materials which is sensitized with a supersensitizer. Useful sensitizing dyes, dye combinations exhibiting supersensitization and materials exhibiting supersensitization are described in RD17643 (published in December, 1978), IV-J at page 23, JP-B 9-25500 and 43-4933 (herein, the term, JP-B means published Japanese Patent) and JP-A 59-19032, 59-192242 and 5-341432.

In this invention, aromatic heterocyclic mercapto compounds represented by the following formula (M) is preferred as a supersensitizer:

Formula (M)

Ar—SM wherein M is a hydrogen atom or an alkali metal atom; Ar is an aromatic ring or condensed aromatic ring containing a nitrogen atom, oxygen atom, sulfur atom, selenium atom or tellurium atom. Such aromatic heterocyclic rings are preferably benzimidazole, naphthoimidazole, benzthiazole, naphthothiazole, benzoxazole, naphthooxazole, benzoselenazole, benzotellurazole, imidazole, oxazole, pyrazole, triazole, triazines, pyrimidine, pyridazine, pyrazine, pyridine, purine, and quinoline. Other aromatic heterocyclic rings may also be included.

A disulfide compound which is capable of forming a mercapto compound when incorporated into a dispersion of an organic silver salt and/or a silver halide grain emulsion is also included in the invention. In particular, a preferred example thereof is a disulfide compound represented by the following formula (Ma):

Formula (Ma)

Ar—S—S—Ar wherein Ar is the same as defined in formula (M). The aromatic heterocyclic rings described above may be substituted with a halogen atom (e.g., Cl, Br, I), a hydroxy group, an amino group, a carboxy group, an alkyl group (having one or more carbon atoms, and preferably 1 to 4 carbon atoms) or an alkoxy group (having one or more carbon atoms, and preferably 1 to 4 carbon atoms).

Examples of the mercapto-substituted aromatic heterocyclic compound are shown below but are not limited to these:

M-1: 2-mercaptobenzimidazole
M-2: 2-mercaptobenzoxazole
M-3: 2-mercaptobenzthiazole
M-4: 5-methyl-2-mercaptobenzimidazole
M-5: 6-ethoxy-2-mercaptobenzthiazole
M-6: 2,2'-dithiobis(benzthiazole)
M-7: 3-mercapto-1,2,4-triazole
M-8: 4,5-diphenyl-2-imidazole
M-9: 2-mercaptoimidazole
M-10: 1-ethyl-2-mercaptobenzimidazole
M-11: 2-mercaptoquinoline
M-12: 8-mercaptopurine
M-13: 2-mercapto-4-(3H)-quinazoline
M-14: 7-trifluoromethyl-4-quinolinethiol
M-15: 2,3,5, 6-tetrachloro-4-pyridinethiol
M-16: 4-amino-6-hydroxy-2-mercaptopyridine monohydrate
M-17: 2-amino-5-mercapto-1,3,4-thiazole
M-18: 3-amino-5-mercapto-1,2,4-triazole
M-19: 4-hydroxy-2-mercaptopyridine
M-20: 2-mercaptopyridine
M-21: 4,6-diamino-2-mercaptopyridine
M-22: 2-mercapto-4-methylpyrimidine hydrochloride
M-23: 3-mercapto-5-phenyl-1,2,4-riazole
M-24: 2-mercapto-4-phenyloxazole (1)

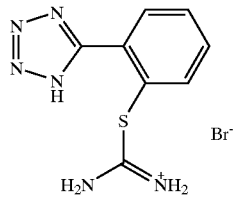

-continued (2)

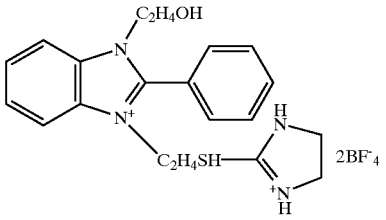

(3)

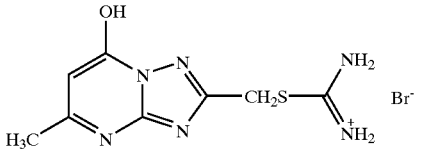

(4)

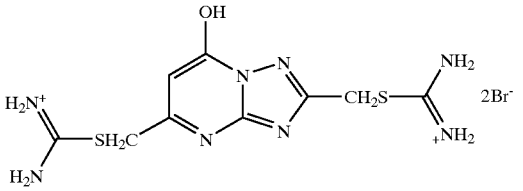

(5)

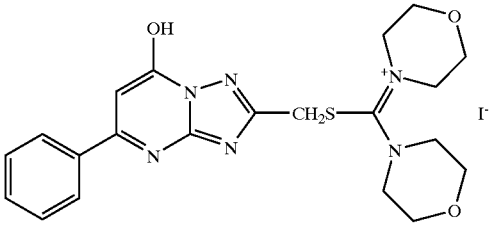

(6)

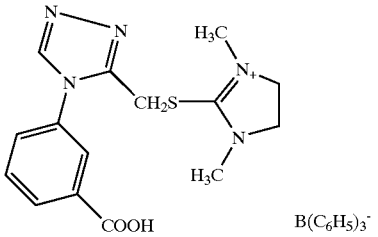

(7)

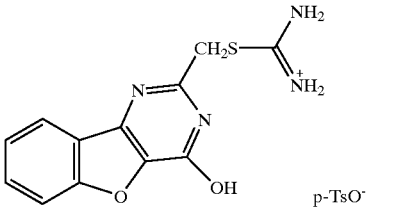

(8)

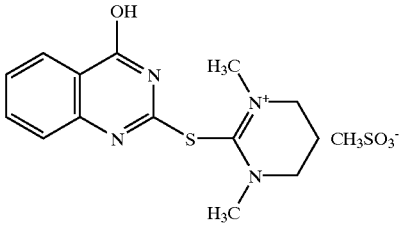

-continued (9)

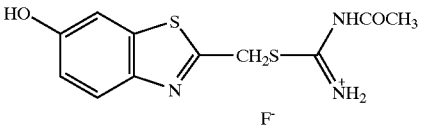

(10)

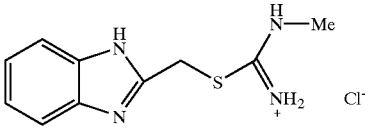

(11)

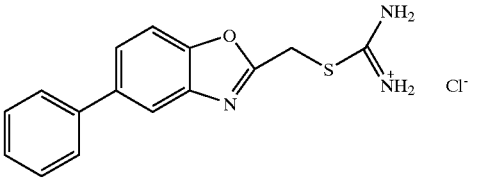

(12)

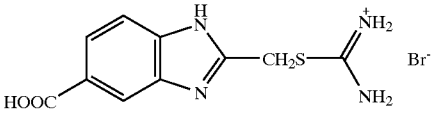

(13)

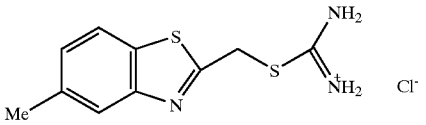

The supersensitizer compound usable in the invention is incorporated into an emulsion layer containing the organic silver salt and silver halide grains, preferably in an amount of 0.001 to 1.0 mol, and more preferably 0.01 to 0.5 mol per mol of the silver amount of organic silver salt and silver halide contents in the light-sensitive layer.

The heteroatom containing macrocyclic compound refers to a nine- or more membered macrocyclic compound containing at least a heteroatom selected from a nitrogen atom, an oxygen atom, a sulfur atom and a selenium atom. The macrocyclic compound is preferably a 12- to 24-membered ring and more preferably 15- to 21-membered ring. Representative compounds thereof include compounds commonly known as a crown ether, which was synthesized by Pederson in 1967 and a number of which have been synthesized since its specific report. The compounds are detailed in C. J. Pederson, Journal of American Chemical Society vol. 86 (2495), 7017–7036 (1967); G. W. Gokel & S. H. Korzeniowski, "Macrocyclic Polyether Synthesis", Springer-Vergal (1982); "Chemistry of Crown Ether" edited by Oda, Shono & Tabuse, published by Kyoritsu Shuppan (1978); "Host-Guest" edited by Tabuse, published by Kyoritsu Shuppan (1979); and Suzuki & Koga, Yuki Gosei Kagaku (Journal of Organic Synthetic Chemistry) vol. 45 (6) 571–582 (1987).

Organic silver salts used in the invention are reducible silver source, and silver salts of organic acids or organic heteroacids are preferred and silver salts of long chain fatty acid (preferably having 10 to 30 carbon atom and more preferably 15 to 25 carbon atoms) or nitrogen containing heterocyclic compounds are more preferred. Specifically, organic or inorganic complexes, ligand of which have a total stability constant to a silver ion of 4.0 to 10.0 are preferred. Exemplary preferred complex salts are described in RD17029 and RD29963, including organic acid salts (for example, salts of gallic acid, oxalic acid, behenic acid, stearic acid, palmitic acid, lauric acid, etc.); carboxyalkylthiourea salts (for example, 1-(3-carboxypropyl)thiourea, 1-(3-caroxypropyl)-3,3-dimethylthiourea, etc.); silver complexes of polymer reaction products of aldehyde with hydroxy-substituted aromatic carboxylic acid (for example, aldehydes (formaldehyde, acetaldehyde, butylaldehyde, etc.), hydroxy-substituted acids (for example, salicylic acid, benzoic acid, 3,5-dihydroxybenzoic acid, 5,5-thiodisalicylic acid, silver salts or complexes of thiones (for example, 3-(2-carboxyethyl)-4-hydroxymethyl-4-(thiazoline-2-thione and 3-carboxymethyl-4-thiazoline-2-thione), complexes of silver with nitrogen acid selected from imidazole, pyrazole, urazole, 1.2,4-thiazole, and 1H-tetrazole, 3-amino-5-benzylthio-1,2,4-triazole and benztriazole or salts thereof; silver salts of saccharin, 5-chlorosalicylaldoxime, etc.; and silver salts of mercaptides. Of these organic silver salts, silver salts of fatty acids are preferred, and silver salts of behenic acid, arachidinic acid and stearic acid are specifically preferred.

The organic silver salt compound can be obtained by mixing an aqueous-soluble silver compound with a compound capable of forming a complex. Normal precipitation, reverse precipitation, double jet precipitation and controlled double jet precipitation described in JP-A 9-127643 are preferably employed. For example, to an organic acid is added an alkali metal hydroxide (e.g., sodium hydroxide, potassium hydroxide, etc.) to form an alkali metal salt soap of the organic acid (e.g., sodium behenate, sodium arachidinate, etc.), thereafter, the soap and silver nitrate are mixed by the controlled double jet method to form organic silver salt crystals. In this case, silver halide grains may be concurrently present.

In the present invention, organic silver salts have an average grain diameter of 2 $\mu$m or less and are monodisperse. The average diameter of the organic silver salt as described herein is, when the grain of the organic salt is, for example, a spherical, cylindrical, or tabular grain, a diameter of the sphere having the same volume as each of these grains. The average grain diameter is preferably between 0.05 and 1.5 $\mu$m, and more preferably between 0.05 and 1.0 $\mu$m. Furthermore, the monodisperse as described herein is the same as silver halide grains and preferred monodispersibility is between 1 and 30%.

It is also preferred that at least 60% of the total of the organic silver salt is accounted for by tabular grains. The tabular grains refer to grains having a ratio of a grain diameter to grain thickness, i.e., aspect ratio (denoted as AR) of 3 or more:

AR=diameter ($\mu$m)/thickness ($\mu$m)

To obtain such tabular organic silver salts, organic silver salt crystals are pulverized together with a binder or surfactant, using a ball mill. Thus, using these tabular grains, photosensitive materials exhibiting high density and superior image fastness are obtained.

To prevent hazing of the photosensitive material, the total amount of silver halide and organic silver salt is preferably 0.5 to 2.2 g in equivalent converted to silver per $m^2$, leading to high contrast images. The amount of silver halide is preferably 50% by weight or less, more preferably 25% by weight or less, and still more preferably 0.1 to 15% by weight, based on the total silver amount.

Reducing agents usable in photothermographic materials relating to this invention include those which are known in the art, such as phenols, polyphenols containing two or more phenol group, naphthols, bis-naphthols, polyhydroxybenzenes containing tw or more hydroxy groups,ascorbic acids, 3-pyrazolidones, pyrazoline-5-ones, pyrazolines, phenylenediamines, hydroxyamines, hydroquinone monoethers, hydroxamic acids, hydrazides, amido-oximes, and N-hydroxyureas. Exemplary examples thereof are described in U.S. Pat. Nos. 3,615,533, 3,679,426, 3,672,904, 3,751,252, 3,782,949, 3,801,321, 3,794,488, 3,893,863, 3,887,376, 3,770,448, 3,819,382, 3,773,512, 3,839,048, 3,887,378, 4,009,038, and 4,021,240, British Patent No. 1,486,148, Belgian patent No. 786,086, JP-A No. 50-36143, 50-36110, 50-116023, 50-99719, 50-140113, 51-51939, 51-23721, 52-84727 and JP-B 51-35851. The reducing agent used in this invention is optionally selected from the foregoing reducing agents. It is the simplest method to prepare a photothermographic material and evaluate its photographic performance to determine superiority of a reducing agent.

In cases where a fatty acid silver salt is used as an organic silver salt, preferred reducing agents include are polyphenols in which two or more phenols are linked through an alkylene group or sulfur, specifically, polyphenols in which two or more phenols substituted with an alkyl group (e.g., methyl, ethyl, propyl, t-butyl, cyclohexyl) or an acyl group (e.g., acetyl, propionyl) at least one of the positions adjacent to a phenolic hydroxy group are linked through an alkylene group or sulfur, including, for example, polyphenols such as 1,1-bis(2-hydroxy-3,5-dimethylphenyl)-3,5,5-trimethylhexane, 1,1-bis(2-hydroxy-3-t-butyl-5-methylphenyl)methane, 1,1-bis(2-hydroxy-3,5-di-t-butylphenyl)methane, (2-hydroxy3-t-butyl-5-methylphenyl) methane, (2-hydroxy-3-t-butyl-5-methylphenyl)-(2-hydroxy-5-methylphenyl)methane, 6,6'-benzylidene-bis(2,4-di-t-butylphenol), 6,6'-benzylidene-bis(20t-butyl-4-methylphenol), 6,6'-benzylidene-bis(2,4-dimethylphenol), 1,1-bis(2-hydroxy-3,5-dimethylphenyl)-2-methylpropane, 1,1,5,5-tetrkis(2-hydroxy-3,5-dimethylphenyl)2,4-ethylpentane, 2,2-bis(4-hydroxy-3,5-dimethyl)propane, and 2,2-bis(4-hydroxy-3,5-di-t-butylphenyl)propane described in U.S. Pat. No. 3,589,903, 4,021,249, British Patent No. 1,486,148, JP-A No. 51-51933, 50-36110, 50-116023, 52-84727, and JP-B No. 51-35727;bisnaphthols described in U.S. Pat. No. 3,672,904, such as 2,2'-dihydoxy-1,1'-binaphthyl, 6,6'-dibromo-2,2'-dihydoxy-1,1'-binaphthyl, 6,6'-dinitro-2,2'-dihydoxy-1,1'-binaphthyl, bis(2-hydroxy-1-naphthyl)methane, 4,4'-dimethoxy-1,1'-dihydroxy-2,2'-binaphthyl; sulfonamidophenols and sulfonamidonaphthols described in U.S. Pat. No. 3,801,321, such as 4-benzenesulfonamidophenol, 2-benzenesulfonamidophenol, 2,6-dichloro-4-benzenesulfonamidophenol and 4-benzenesulfonamidonaphthol.

The content of the reducing agent of the photothermographic material, depending of the kind of an organic silver salt or reducing agent, or other addenda, is preferably 0.05 to 10 mol, and more preferably 0.1 to 3 mol per mol of organic silver salt. Plural reducing agents may be contained within the range described above.

There is preferably employed an additive, a so-called image toning agent, color tone-providing or activator toner (hereinafter, called image toning agent) in the photothermographic material. The image toning agent takes part in an oxidation-reduction reaction of an organic silver salt and a reducing agent, having function of density-increasing or blackening produced silver images. Preferred image toning agents are described in Research Disclosure item 17029. Example thereof include imides (for example, phthalimide), cyclic imides, pyrazoline-5-one, and quinazolinone (for example, succinimide, 3-phenyl-2-pyrazoline-5-on, 1-phenylurazole, quinazoline and 2,4-thiazolidione); naphthalimides (for example, N-hydroxy-1,8-naphthalimide); cobalt complexes (for example, cobalt hexaminetrifluoroacetate), mercaptans (for example, 3-mercapto-1,2,4-triazole); N-(aminomethyl) aryldicarboxyimides (for example, N-(dimethylaminomethyl)phthalimide); blocked pyrazoles, isothiuronium derivatives and combinations of certain types of light-bleaching agents (for example, combination of N,N'-hexamethylene (1-carbamoyl-3,5-dimethylpyrazole), 1,8-(3,6-dioxaoctane)bis-(isothiuroniumtrifluoroacetate), and 2-(tribromomethyl-sulfonyl)benzothiazole; merocyanine dyes (for example, 3-ethyl-5-((3-etyl-2-benzothiazolinylidene-(benzothiazolinylidene))-1-methylethylidene-2-thio-2,4-oxazolidinedione); phthalazinone, phthalazinone derivatives or metal salts thereof (for example, 4-(1-naphthyl) phthalazinone, 6-chlorophthalazinone, 5,7-dimethylphthalazinone, and 2,3-dihydro-1,4-phthalazinedione); combinations of phthalazinone and sulfinic acid derivatives (for example, 6-chlorophthalazinone and benzenesulfinic acid sodium, or 8-methylphthalazinone and p-trisulfonic acid sodium); combinations of phthalazine and phthalic acid; combinations of phthalazine (including phthalazine addition products) with at least one compound selected from maleic acid anhydride, and phthalic acid, 2,3-naphthalenedicarboxylic acid or o-phenylenic acid derivatives and anhydrides thereof (for example, phthalic acid, 4-methylphthalic acid, 4-nitrophthalic acid, and tetrachlorophthalic acid anhydride); quinazolinediones, benzoxazine, naphthoxazine derivatives, benzoxazine-2,4-diones (for example, 1,3-benzoxazine-2,4-dione); pyrimidines and asymmetry-triazines (for example, 2,4-dihydroxypyrimidine), and tetraazapentalene derivatives (for example, 3,6-dimercapto-1,4-diphenyl-1H,4H-2,3a, 5,6a-tatraazapentalene). Preferred tone modifiers include phthalazone or phthalazine.

Binders suitable for the thermally developable photosensitive material to which the present invention is applied are transparent or translucent, and generally colorless. Binders are natural polymers, synthetic resins, and polymers and copolymers, other film forming media; for example, gelatin, gum arabic, poly(vinyl alcohol), hydroxyethyl cellulose, cellulose acetate, cellulose acetatebutylate, poly(vinyl pyrrolidone), casein, starch, poly(acrylic acid), poly(methyl methacrylic acid), poly(vinyl chloride), poly(methacrylic acid), copoly(styrene-maleic acid anhydride), copoly (styrene-acrylonitrile, copoly(styrene-butadiene, poly(vinyl acetal) series [e.g., poly(vinyl formal)and poly(vinyl butyral), polyester series, polyurethane series, phenoxy resins, poly(vinylidene chloride), polyepoxide series, polycarbonate series, poly(vinyl acetate) series, cellulose esters, poly(amide) series. Of these binders are preferred aqueous-insoluble polymers such as cellulose acetate, cellulose acetate-butylate and poly(vinyl butyral); and poly(vinyl formal) and poly(vinyl butyral) are specifically preferred as a polymer used in the thermally developable photosensitive layer; and cellulose acetate and cellulose acetate-butylate are preferably used in a protective layer and backing layer.

The amount of the binder in the light-sensitive layer is preferably between 1.5 and 6 g/m$^2$, and is more preferably between 1.7 and 5 g/m$^2$. The binder content of less than 1.5 g/m$^2$ tends to increase a density of unexposed area to levels unacceptable in practical use.

In the present invention, a matting agent is preferably incorporated into the image forming layer side. In order to minimize the image abrasion after thermal development, the matting agent is provided on the surface of a photosensitive material and the matting agent is preferably incorporated in an amount of 0.5 to 30 per cent in weight ratio with respect to the total binder in the emulsion layer side.

In cases where a non photosensitive layer is provided on the opposite side of the support to the photosensitive layer, it is preferred to incorporate a matting agent into at least one of the non-photosensitive layer (and more preferably, into the surface layer) in an amount of 0.5 to 40% by weight, based on the total binder on the opposite side to the photosensitive layer.

Materials of the matting agents employed in the present invention may be either organic substances or inorganic substances. Examples of the inorganic substances include silica described in Swiss Patent No. 330,158, etc.; glass powder described in French Patent No. 1,296,995, etc.; and carbonates of alkali earth metals or cadmium, zinc, etc. described in U.K. Patent No. 1.173,181, etc. Examples of the organic substances include starch described in U.S. Pat. No. 2,322,037, etc.; starch derivatives described in Belgian Patent No. 625,451, U.K. Patent No. 981,198, etc.; polyvinyl alcohols described in Japanese Patent Publication No. 44-3643, etc.; polystyrenes or polymethacrylates described in Swiss Patent No. 330,158, etc.; polyacrylonitriles described in U.S. Pat. No. 3,079,257, etc.; and polycarbonates described in U.S. Pat. No. 3,022,169.

The shape of the matting agent may be crystalline or amorphous. However, a crystalline and spherical shape is preferably employed. The size of a matting agent is expressed in the diameter of a sphere having the same volume as the matting agent. The particle diameter of the matting agent in the present invention is referred to the diameter of a spherical converted volume. The matting agent employed in the present invention preferably has an average particle diameter of 0.5 to 10 $\mu$m, and more preferably of 1.0 to 8.0 $\mu$m. Furthermore, the variation coefficient of the size distribution is preferably not more than 50 percent, is more preferably not more than 40 percent, and is most preferably not more than 30 percent.

The matting agent can be incorporated into any layer. In order to accomplish the object of the present invention, the matting agent is preferably incorporated into the layer other than the photosensitive layer, and is more preferably incorporated into the farthest layer from the support. Addition methods of the matting agent include those in which a matting agent is previously dispersed into a coating composition and is then coated, and prior to the completion of drying, a matting agent is sprayed. When plural matting agents are added, both methods may be employed in combination.

The photothermographic material according to the invention comprises a support having thereon at least one light-sensitive layer, and at least a light-insensitive layer may be further provided on the light-sensitive layer. There may be provided a filter layer to control the amount or wavelength distribution of light transmitting through the light-sensitive layer on the light-sensitive layer side or on the opposite side. Alternatively, a dye or pigment may be allowed to contain in the light-sensitive layer. In such a case, dyes described in JP-A 8-201959 are preferred. The light-sensitive layer may be composed of a plurality of layers. To adjust gradation, layers may be arranged in such a manner as a high-speed layer/low-speed layer or a low-speed layer/high-speed layer. Further, various additives may be incorporated into either the light-sensitive layer or light-insensitive layer, or both of them. Examples thereof include a surfactant, an antioxidant, a stabilizer, a plasticizer, UV absorbent, and a coating aid.

To expose photothermographic material to light, argon ion laser (488 nm), He-Ne laser (633 nm), red semiconductor laser (670 nm), infrared semiconductor laser (780 nm, 820 nm) are preferably employed. Infrared semiconductor laser is specifically preferred in terms of high power and transmission capability through the photothermographic material.

In the invention, exposure is preferably conducted by laser scanning exposure. It is also preferred to use a laser exposure apparatus, in which scanning laser light is not exposed at an angle substantially vertical to the exposed surface of the photosensitive material. The expression "laser light is not exposed at an angle substantially vertical to the exposed surface" means that laser light is exposed preferably at an angle of 55 to 88°, more preferably 60 to 86°, still more preferably 65 to 84, and optimally 70 to 82°. When the photosensitive material is scanned with laser light, the beam spot diameter on the surface of the photosensitive material is preferably not more than 200 μm, and more preferably not more than 100 μm. Thus, the less spot diameter preferably reduces an angle displacing from verticality of the laser incident angle. The lower limit of the beam spot diameter is 10 μm. The thus laser scanning exposure can reduce deterioration in image quality due to reflection light, such as occurrence of interference fringe-like unevenness.

Exposure applicable in the invention is conducted preferably using a laser scanning exposure apparatus producing longitudinally multiple scanning laser light, whereby deterioration in image quality such as occurrence of interference fringe-like unevenness is reduced, as compared to scanning laser light with longitudinally single mode. Longitudinal multiplication can be achieved by a technique of employing backing light with composing waves or a technique of high frequency overlapping. The expression "longitudinally multiple" means that the exposure wavelength is not a single wavelength. The exposure wavelength distribution is usually not less than 5 nm and not more than 10 nm. The upper limit of the exposure wavelength distribution is not specifically limited but usually about 60 nm.

Photothermographic materials relating to this invention, after subjected to exposure, is developed by heating at a relatively high temperature. The heating temperature is preferably not less than 80° C. and not more than 200° C., and more preferably not less than 100° C. and not more than 150° C. At a heating temperature lower than 80° C., a sufficient image density cannot be obtained within a short period of time and at a heating temperature higher than 200° C., binder melts, causing transfer to rollers and disadvantageously affecting not only images themselves but also transportability or a processor. Silver images are formed through an oxidation-reduction reaction between an organic silver salt (which functions as an oxidizing agent) and a reducing agent upon heating. The reaction proceeds without supplying externally a processing solution such as water.

EXAMPLES

The present invention will be further described based on examples but embodiments of the invention are by no means limited to these examples.

EXAMPLE 1

Backing Layer

Both sides of a blue-tinted, 175 μm thick polyethylene terephthalate (PET) film having a blue density of 0.170 (which was tinted with Dye 1 and the blue density was measured by densitometer PDA-65, available from Konica Corp.) was subjected to corona discharge at 8 W/m$^2$ to prepare a photographic support. On one side of the thus prepared support, a coating solution of a backing layer, as described below, was coated by an extrusion coater so as to form a dry thickness of 3.5 μm and dried employing hot air at a drying temperature of 100° C. and a dew point of 10° C. over a period of 5 min. to form the backing layer.

Preparation of Backing Layer Coating Solution

To 830 g of methyl ethyl ketone, 84.2 g of cellulose acetate-butylate (CAB381-20, available from Eastman Chemical Co.) and 4.5 g of polyester resin (Vitel PE2200B, available from Bostic Corp.) were added with stirring and dissolved therein. To the resulting solution was added 0.30 g of infrared dye 1 and 4.5 g fluorinated surfactant (Surflon KH40, available from ASAHI Glass Co. Ltd.) and 2.3 g fluorinated surfactant (Megafag F120K, available from DAINIPPON INK Co. Ltd.) which were dissolved in 43.2 g methanol, were added thereto and stirred until being dissolved. Then, 75 g of silica (Siloid 64X6000, available from W. R. Grace Corp.), which was dispersed in methyl ethyl ketone in a concentration of 1 wt % using a dissolver type homogenizer, was further added thereto with stirring to obtain a coating solution A for backing layer.

Light Sensitive Layer

Preparation of Light-Sensitive Silver Halide Emulsion 1

| | |
|---|---|
| Solution A1 | |
| Phenylcarbamoyl gelatin | 88.3 g |
| Compound (A) (10% methanol solution) | 10 ml |
| Potassium bromide | 0.32 g |
| Water to make | 5429 ml |
| Solution B1 | |
| 0.67 mol/l Aqueous silver nitrate solution | 2635 ml |
| Solution C1 | |
| Potassium bromide | 51.55 g |
| Potassium iodide | 1.47 g |
| Water to make | 660 ml |
| Solution D1 | |
| Potassium bromide | 154.9 g |
| Potassium iodide | 4.41 g |
| Iridium chloride (1% solution) | 0.93 ml |
| Solution E1 | |
| 0.4 mol/l aqueous potassium bromide solution | |
| Amount necessary to adjust silver potential | |
| Solution F1 | |
| Aqueous 56% acetic acid solution | 16 ml |
| Solution G1 | |
| Anhydrous sodium carbonate | 1.72 g |
| Water to make | 151 ml |
| Compound (A) | |
| $HO(CH_2CH_2O)_n—(CH(CH_3)CH_2O)_{17}—CH_2CH_2O)_mH$ | |
| (m + n = 5 to 7) | |

Using a stirring mixer described in JP-B 58-58288 and 58-58289, ¼ of solution B1, the total amount of solution C1 were added to solution A1 by the double jet addition for 4 min 45 sec. to form nucleus grain, while maintaining a temperature of 45° C. and a pAg of 8.09. After 7 min, ¾ of solution B1 and the total amount of solution D1 were further added by the double jet addition for 14 min 15 sec., while mainlining a temperature of 45° C., a pAg of 8.09 and a pH of 5.6. After stirring for 5 min., the reaction mixture was lowered to 40° C. and solution F1 was added thereto to coagulate the resulting silver halide emulsion. Remaining 2000 ml of precipitates, the supernatant was removed and after adding 10 lit. water with stirring, the silver halide emulsion was again coagulated. Remaining 1500 ml of precipitates, the supernatant was removed and after adding 10 lit. water with stirring, the silver halide emulsion was again coagulated. Remaining 1500 ml of precipitates, the supernatant was removed and solution G1 was added. The temperature was raised to 60° C. and stirring continued for 120 min. Finally, the pH was adjusted to 5.8 and water was added there to so that the weight per mol of silver was 1161 g, and light-sensitive silver halide emulsion 1 was thus obtained. It was proved that the resulting emulsion was comprised of monodisperse silver iodobromide cubic grains having an average grain size of 0.058 μm, a coefficient of variation of grain size of 12% and a [100] face ratio of 92%.

Preparation of Powdery Organic Silver Salt

In 4720 ml water were dissolved 111.4 g of behenic acid, 83.8 g of arachidic acid and 54.9 g of stearic acid at 80° C. The, after adding 540.2 ml of 1.5M aqueous sodium hydroxide solution with stirring and further adding 6.9 ml of concentrated nitric acid, the solution was cooled to a temperature of 55° C. to obtain an aqueous organic acid sodium salt solution. To the solution were added the silver halide emulsion (equivalent to 0.038 mol silver) and 450 ml water and stirring further continued for 5 min., while maintained at a temperature of 55° C. Subsequently, 760.6 ml of 1M aqueous silver nitrate solution was added in 2 min. and stirring continued further for 20 min., then, the reaction mixture was filtered to remove aqueous soluble salts. Thereafter, washing with deionized water and filtration were repeated until the filtrate reached a conductivity of 2 $\mu$S/cm, and after subjecting to centrifugal dehydration, the reaction product was dried with heated air at 37° C. until no reduction in weight was detected to obtain a powdery organic silver salt.

Preparation of Preliminarily Dispersed Solution

In 1457 g methyl ethyl ketone was dissolved 14.57 g of polyvinyl butyral powder (Butvar B-79, available from Monsanto Corp.) and further thereto, 500 g of the powdery organic silver salt with stirring by dissolver DISPERMAT CA-40M type (available from VMA-GETZMANN Corp.) was gradually added to obtain a preliminary dispersion.

Preparation of Light Sensitive Emulsion-Dispersed Solution

Using GM-2 type, pressure-type homogenizer (available from S.T.M. Corp.), the preliminary dispersion was dispersed two times to obtain light-sensitive emulsion-dispersed solution, wherein the treatment pressure at the first path was 27.4 MPa and that of the second path was 54.92 MPa.

Subsequently, there were prepared the following solutions necessary to prepare a coating solution of the light sensitive elayer.

| Stabilizer solution | |
|---|---|
| Stabilizer 1 (as shown below) | 1.00 g |
| Potassium acetate | 0.31 g |
| Methanol | 10 g |
| Infrared-sensitizing dye solution | |
| Infrared-sensitizing dye 1 (shown below) | 41 mg |
| 2-Chlorobenzoic acid | 2 g |
| Compound A (shown below) | 21.0 g |
| MEK | 100 g |

-continued

| Adding solution A | |
|---|---|
| 1,1-Bis(2-hydroxy-3,5-dimethylphenyl)-3,5,5-trimethylhexane | 51.0 g |
| 4-methylphthalic acid | 3.40 g |
| Infrared dye 1 (shown below) | 0.22 g |
| MEK | 170 g |

Preparation of Coating Solution of Light Sensitive Layer

The light-sensitive emulsion-dispersed solution of 100 g and 45 g MEK were maintained at 25° C. with stirring. Then, 0.65 g of antifoggant 1 solution (10% by weight methanol solution) was added and stirred for 1 hr. and 0.84 g of calcium bromide solution (10% by weight methanol solution) was added and further stirred for 20 min. Subsequently, 0.70 g of the stabilizer solution was further added thereto and after stirring for 10 min., 7.90 g of the infrared sensitizing dye solution was added, stirred for 1 hr. Further, 1.50 g of a supersensitizer 1 solution (1% by weight methanol solution) was added and stirred for 30 min., then, cooled to 13° C. and further stirred for 30 min.

Further, 26 g of polyvinyl butyral (Butvar B-79, available from Monsanto Corp.) was added thereto and after 15 min., 2.3 g of tetrachlorophthalic acid (13% by weight MEK solution) was added. Then, 4.5 g of 22% by weight MEK solution of isocyanate compound IC-10, 27.0 g of the adding solution A, 6.0 g of 6.5% by weight MEK solution of halogen compound 1a-1 and 9.0 g of 7% by weight MEK solution of phthalazinone were successively added with stirring to obtain a coating solution of the light sensitive layer.

Surface Protective Layer

Preparation of Matting Agent Dispersion

Cellulose acetate butyrate (7.5 g of CAB171-15, available from Eastman Chemical Co.) was dissolved in 42.5 g of MEK, then, 5 g of calcium carbonate (Super-Pflex 200, available from Specility Mineral Corp.) was added thereto and dispersed using a dissolver type homogenizer at 8000 rpm for 30 min to obtain a matting agent dispersion.

Preparation of Protective Layer Coating Solution

To 865 g of methyl ethyl ketone were added with stirring 96 g of cellulose acetate butyrate (CAB171-15, available from Eastman Chemical Co.) and 4.5 g of polymethyl methacrylate (Paraloid A-21, available from Rohm & Haas Corp.). Further thereto were added and dissolved 1.5 g of vinylsulfone compound shown below, 1.0 g of benzotriazole and 1.0 g of fluorinated surfactant (Surflon KH40, available from ASAHI Glass Co. Ltd.). Then, 30 g of the matting agent dispersion was further added thereto to obtain a coating solution of the surface protective layer.

Stabilizer 1

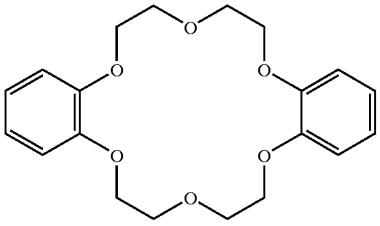

-continued

Infrared dye 1

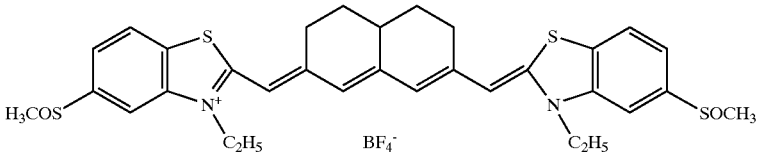

Compound A

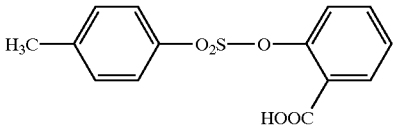

Infrared dye

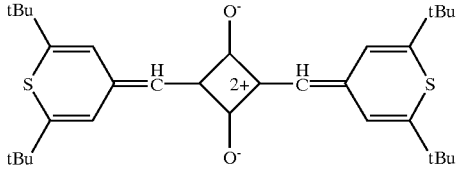

Antifoggant 1

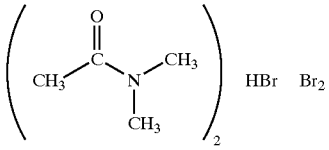

Supersensitizer 1

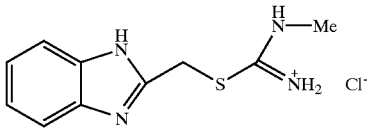

IC-10

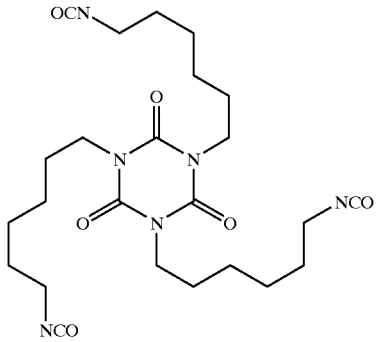

Vinylsulfone compound

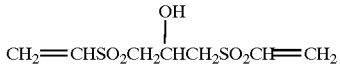

Preparation of Photothermographic Material

Coating solutions of the light sensitive layer and surface protective layer were simultaneously coated using an extrusion coater so that the silver coverage of the light sensitive layer was 1.9 g/m$^2$ and the dry thickness of the surface protective layer was 2.5 $\mu$m. Drying was conducted with hot air at a drying temperature of 75° C. and a dew point of 10° C. for 10 min to obtain a photothermographic material sample No. 1-1.

Exposure and Processing

The thus prepared photothermographic material was subjected to laser scanning exposure from the emulsion side using an exposure apparatus having a light source of 800 to 820 nm semiconductor laser of a longitudinal multi-mode, which was made by means of high frequency overlapping. In this case, exposure was conducted at 75° C. of an angle between the exposed surface and exposing laser light. The exposed photothermographic material was subjected to thermal development at 115° C. for 15 sec., while bringing the protective layer surface of the photothermographic material into contact with the heated drum surface.

Evaluation of Sensitivity and Fog

The thus obtained image was measured to evaluate sensitivity and fog density. Sensitivity was represented by a relative log E speed, in which E is exposure giving a density of 1.0 higher than an unexposed area density. Separately, the photothermographic material was allowed to stand under the condition of a temperature of 50° C. and a relative humidity (also denoted as RH) of 75%, thereafter, the thus aged photothermographic material was similarly subjected to exposure and thermal development, and evaluated with respect to sensitivity and fog density.

Evaluation of Fogging in 117° C. Development

The photothermographic material was also subjected to thermal development at 117° C. for 15 sec. and evaluated with fogging.

Evaluation of Fogging due to Printing-Out and Image Tone

Exposed and developed photothermographic materials were exposed on the 10,000 lux light source table (under a fluorescent lump) and variation in density thereof was measured until max. 20 hrs. Further, silver image tone of an area exhibiting a transmission density of 1.1+0.05 was evaluated based on the following criteria:

Evaluation Criteria

5: neutral black tone and no yellowish tone was observed,

4: not neutral black tone but yellowish tone was scarcely observed,

3: yellowish tone was slightly observed

2: slightly yellowish tone was overall observed, and

1: yellowish tone was apparently observed.

Furthermore, after being printed out, storage stability was evaluated with respect to variation in fog density. Thus, photothermographic material samples which were previously subjected to exposure for 20 hrs., were allowed to stand under an atmosphere of 55° C. and 75% RH and measured with respect to fog density.

Photothermographic Material Samples No. 1-2 through 1-21

Photothermographic material samples No. 1-2 through 1-21 were prepared similarly to Example 1, except that the halogen-containing compound and isocyanate compound were each varied as shown in Table 1. The amount of an isocyanate compound was equivalent with respect to —NCO group. Results are shown in Tables 1 and 2.

TABLE 1

| Sample | Halogen containing Compd. (relative molar ratio) | | Iso-cyanate Compd. | Fog (*1) | Variation in Fog at 117° C. Dev. | Variation in Fog after Storage | Sensi-tivity (log E) | Variation in sensitivity after Storage |
|---|---|---|---|---|---|---|---|---|
| 1-1 (Inv.) | 1a-1 | 1 | IC-10 | 0.220 | 0.005 | 0.010 | 1.80 | 0.00 |
| 1-2 (Inv.) | 1a-1 | 2 | IC-10 | 0.190 | 0.000 | 0.003 | 1.75 | −0.04 |
| 1-3 (Comp.) | AF-1 | 1 | IC-10 | 0.230 | 0.010 | 0.025 | 1.75 | −0.15 |
| 1-4 (Comp.) | AF-1 | 2 | IC-10 | 0.197 | 0.005 | 0.012 | 1.50 | −0.30 |
| 1-5 (Inv.) | 1a-6 | 2 | IC-10 | 0.185 | 0.000 | 0.000 | 1.80 | −0.04 |
| 1-6 (Inv.) | 1a-14 | 2 | IC-10 | 0.192 | 0.002 | 0.003 | 1.75 | −0.10 |
| 1-7 (Inv.) | 1a-15 | 2 | IC-10 | 0.192 | 0.002 | 0.000 | 1.70 | 0.05 |
| 1-8 (Inv.) | 1a-19 | 2 | IC-10 | 0.188 | 0.000 | 0.002 | 1.60 | 0.00 |
| 1-9 (Inv.) | 1c-1 | 2 | IC-10 | 0.180 | 0.000 | −0.002 | 1.50 | −0.20 |
| 1-10 (Inv.) | 1b-1 | 2 | IC-10 | 0.190 | 0.003 | 0.009 | 1.70 | −0.07 |
| 1-11 (Inv.) | 1b-5 | 2 | IC-10 | 0.193 | 0.003 | 0.007 | 1.75 | −0.08 |
| 1-12 (Inv.) | 1b-11 | 2 | IC-10 | 0.195 | 0.005 | 0.010 | 1.70 | −0.10 |
| 1-13 (Inv.) | 1b-14 | 2 | IC-10 | 0.195 | 0.005 | 0.005 | 1.63 | 0.08 |
| 1-14 (Inv.) | 1b-29 | 2 | IC-10 | 0.190 | 0.000 | 0.002 | 1.82 | −0.02 |
| 1-15 (Inv.) | 1b-30 | 1 | IC-10 | 0.185 | 0.000 | 0.002 | 1.85 | −0.05 |
| 1-16 (Inv.) | 1c-2 | 2 | IC-10 | 0.185 | 0.000 | 0.008 | 1.52 | −0.20 |
| 1-17 (Inv.) | 1b-24 | 2 | IC-10 | 0.202 | 0.008 | 0.015 | 1.72 | −0.15 |
| 1-18 (Comp.) | AF-2 | 2 | IC-10 | 0.205 | 0.010 | 0.030 | 1.70 | −0.20 |
| 1-19 (Inv.) | 1a-1 | 2 | IC-11 | 0.195 | 0.000 | 0.006 | 1.77 | −0.01 |
| 1-20 (Inv.) | 1a-1 | 2 | IC-12 | 0.193 | 0.000 | 0.006 | 1.77 | −0.05 |
| 1-21 (Inv.) | 1a-1 | 2 | IC-13 | 0.200 | 0.005 | 0.007 | 1.78 | −0.10 |
| 1-22 (Inv.) | 1a-1 | 2 | — | 0.220 | 0.010 | 0.010 | 1.80 | −0.10 |
| 1-23 (Comp.) | AF-1 | 2 | — | 0.230 | 0.010 | 0.020 | 1.60 | −0.30 |

TABLE 2

| Sample | PO-1H (variation from *1) | PO-3H (variation from 1H) | PO-20H (variation from 1H) | PO Image tone | Variation in Fog during storage after PO |
|---|---|---|---|---|---|
| 1-1 (Inv.) | 0.020 | 0.003 | 0.000 | 5 | 0.030 |
| 1-2 (Inv.) | 0.010 | 0.000 | 0.000 | 5 | 0.005 |
| 1-3 (Comp.) | 0.020 | −0.005 | −0.007 | 4 | 0.050 |
| 1-4 (Comp.) | 0.015 | −0.008 | −0.010 | 3 | 0.030 |
| 1-5 (Inv.) | 0.010 | 0.000 | 0.000 | 5 | 0.003 |
| 1-6 (Inv.) | 0.012 | 0.001 | 0.002 | 5 | 0.005 |
| 1-7 (Inv.) | 0.008 | 0.000 | 0.000 | 5 | 0.010 |
| 1-8 (Inv.) | 0.010 | −0.002 | −0.003 | 5 | 0.010 |
| 1-9 (Inv.) | 0.008 | −0.003 | −0.005 | 5 | 0.003 |
| 1-10 (Inv.) | 0.013 | 0.000 | 0.000 | 5 | 0.010 |
| 1-11 (Inv.) | 0.011 | −0.001 | −0.001 | 5 | 0.010 |
| 1-12 (Inv.) | 0.015 | 0.002 | 0.002 | 5 | 0.015 |
| 1-13 (Inv.) | 0.010 | 0.000 | 0.000 | 5 | 0.020 |
| 1-14 (Inv.) | 0.007 | 0 | 0 | 5 | 0.008 |
| 1-15 (Inv.) | 0.003 | 0 | 0 | 5 | 0.003 |
| 1-16 (Inv.) | 0.008 | −0.003 | −0.005 | 5 | 0.005 |

TABLE 2-continued

| Sample | PO-1H (variation from *1) | PO-3H (variation from 1H) | PO-20H (variation from 1H) | PO Image tone | Variation in Fog during storage after PO |
|---|---|---|---|---|---|
| 1-17 (Inv.) | 0.015 | 0.002 | 0.003 | 4 | 0.040 |
| 1-18 (Comp.) | 0.025 | 0.005 | 0.008 | 4 | 0.080 |
| 1-19 (Inv.) | 0.010 | 0.000 | 0.000 | 5 | 0.010 |
| 1-20 (Inv.) | 0.010 | 0.000 | 0.000 | 5 | 0.020 |
| 1-21 (Inv.) | 0.012 | 0.002 | 0.002 | 4 | 0.025 |
| 1-22 (Inv.) | 0.012 | 0.000 | 0.000 | 4 | 0.030 |
| 1-23 (Comp.) | 0.020 | −0.010 | −0.015 | 2 | 0.050 |

*1: PO: Print-out after exposure

In Table 1, chemical structures of AF-1, AF-2, IC-1 through IC-13 are as follows.

AF-1

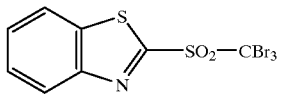

AF-2

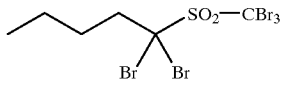

IC-11

IC-12

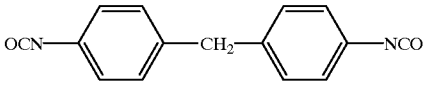

-continued

IC-13

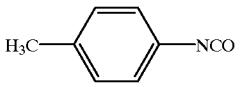

According to this invention, there are provided photothermographic materials exhibiting enhanced sensitivity without causing an increase of fogging, reduced fogging, variation in sensitivity or deterioration in image color during storage, superior image stability, and improvements in disadvantageous fogging caused by development at a higher temperature.

EXAMPLE 2

Photothermographic material samples 31 through 49 were prepared similarly to Example 1, provided that the halogen compound was replaced by a triazine compound, as shown in Table 3. The thus prepared samples were also evaluated similarly to Example 1. Results are shown in Table 3.

TABLE 3

| Sample | Triazine Compound | (relative molar ratio) | Isocyanate Compd. | Fog (*1) | Variation in Fog after Storage | Sensitivity (log E) | Variation in sensitivity after Storage |
|---|---|---|---|---|---|---|---|
| 2-1 | TZ-014 | 1 | IC-10 | 0.210 | 0.010 | 1.70 | 0.00 |
| 2-2 | TZ-014 | 2 | IC-10 | 0.190 | 0.003 | 1.73 | −0.04 |
| 2-3 | AF-1 | 1 | IC-10 | 0.215 | 0.020 | 1.65 | −0.15 |
| 2-4 | AF-1 | 2 | IC-10 | 0.193 | 0.012 | 1.20 | −0.30 |
| 2-5 | AF-2 | 0.5 | IC-10 | 0.220 | 0.010 | 1.45 | −0.30 |
| 2-6 | AF-2 | 1 | IC-10 | 0.190 | 0.005 | 0.30 | — |
| 2-7 | TZ-014 | 2 | IC-11 | 0.193 | 0.003 | 1.75 | −0.04 |
| 2-8 | TZ-014 | 2 | IC-12 | 0.193 | 0.003 | 1.75 | −0.03 |
| 2-9 | TZ-014 | 2 | IC-13 | 0.195 | 0.003 | 1.75 | 0.02 |
| 2-10 | TZ-014 | 2 | — | 0.205 | 0.015 | 1.80 | 0.02 |
| 2-11 | AF-1 | 2 | — | 0.205 | 0.020 | 1.30 | 0.10 |
| 2-12 | TZ-001 | 2 | IC-10 | 0.195 | 0.008 | 1.73 | −0.10 |
| 2-13 | TZ-009 | 2 | IC-10 | 0.200 | 0.010 | 1.65 | −0.10 |
| 2-14 | TZ-012 | 2 | IC-10 | 0.200 | 0.008 | 1.70 | −0.05 |
| 2-15 | TZ-015 | 2 | IC-10 | 0.185 | 0.002 | 1.68 | −0.03 |
| 2-16 | TZ-021 | 2 | IC-10 | 0.192 | 0.003 | 1.70 | −0.05 |
| 2-17 | TZ-017 | 2 | IC-10 | 0.190 | 0.000 | 1.65 | −0.05 |
| 2-18 | TZ-019 | 2 | IC-10 | 0.193 | 0.002 | 1.60 | −0.07 |
| 2-19 | TZ-022 | 2 | IC-10 | 0.193 | 0.003 | 1.60 | −0.08 |
| 2-20 | TZ-013 | 2 | IC-10 | 0.195 | 0.010 | 1.78 | −0.02 |
| 2-21 | TZ-018 | 2 | IC-10 | 0.190 | 0.012 | 1.75 | 0.02 |
| 2-22 | TZ-024 | 2 | IC-10 | 0.193 | 0.014 | 1.73 | 0.00 |
| 2-23 | TZ-001 | 2 | — | 0.210 | 0.021 | 1.81 | 0.10 |
| 2-24 | TZ-012 | 2 | — | 0.215 | 0.025 | 1.90 | 0.200 |
| 2-25 | TZ-013 | 2 | — | 0.220 | 0.020 | 1.90 | 0.200 |

| Sample | PO-1H (variation from *1) | PO-3H (variation from 1H) | PO-20H (variation from 1H) | PO Image tone | Variation in Fog during storage after PO | Remarks |
|---|---|---|---|---|---|---|
| 2-1 | 0.020 | 0.003 | 0.003 | 5 | 0.015 | Inv. |
| 2-2 | 0.010 | 0.000 | 0.000 | 5 | 0.006 | Inv. |
| 2-3 | 0.020 | −0.005 | −0.007 | 4 | 0.030 | Comp. |
| 2-4 | 0.013 | −0.005 | −0.007 | 2 | 0.020 | Comp. |
| 2-5 | 0.025 | 0.008 | 0.010 | 3 | 0.006 | Comp. |
| 2-6 | 0.020 | 0.005 | 0.007 | 2 | 0.005 | Comp. |
| 2-7 | 0.012 | 0.002 | 0.002 | 5 | 0.010 | Inv. |
| 2-8 | 0.015 | 0.003 | 0.003 | 5 | 0.010 | Inv. |
| 2-9 | 0.020 | 0.003 | 0.003 | 5 | 0.015 | Inv. |
| 2-10 | 0.020 | 0.005 | 0.005 | 5 | 0.020 | Inv. |
| 2-11 | 0.020 | −0.010 | −0.015 | 3 | 0.030 | Comp. |
| 2-12 | 0.013 | 0.002 | 0.003 | 5 | 0.010 | Inv. |
| 2-13 | 0.015 | 0.003 | 0.005 | 4 | 0.012 | Inv. |
| 2-14 | 0.015 | 0.002 | 0.003 | 5 | 0.009 | Inv. |
| 2-15 | 0.008 | 0.000 | 0.000 | 5 | 0.004 | Inv. |
| 2-16 | 0.011 | 0.000 | 0.000 | 5 | 0.006 | Inv. |
| 2-17 | 0.010 | −0.002 | −0.003 | 5 | 0.007 | Inv. |
| 2-18 | 0.010 | −0.003 | −0.005 | 4 | 0.009 | Inv. |
| 2-19 | 0.010 | −0.005 | −0.007 | 3 | 0.015 | Inv. |
| 2-10 | 0.012 | 0.001 | 0.002 | 5 | 0.010 | Inv. |
| 2-21 | 0.013 | 0.002 | 0.002 | 5 | 0.008 | Inv. |
| 2-22 | 0.012 | −0.003 | −0.005 | 3 | 0.009 | Inv. |
| 2-23 | 0.024 | 0.010 | 0.010 | 4 | 0.030 | Comp. |
| 2-24 | 0.030 | 0.012 | 0.015 | 5 | 0.035 | Comp. |
| 2-25 | 0.025 | 0.007 | 0.100 | 5 | 0.030 | Comp. |

*1: PO: Print-out after exposure

As can be seen from Table 3, it was proved that photothermographic materials according to this invention exhibited superior results similarly to Example 1.

What is claimed is:

1. A photothermographic material comprising on a support a) an organic silver salt, b) a light-sensitive silver halide, c) a reducing agent and d) a compound represented by formula (1), 6-aryl-2,4-bis(tribromomethyl)-s-triazine or 6-heteroaryl-2,4-bis(tribromomethyl)-s-triazine:

formula (1)

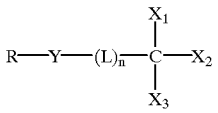

wherein $X_1$, $X_2$ and $X_3$ are each a hydrogen atom or a substituent group, provided that at least one of $X_1$, $X_2$ and $X_3$ is a halogen atom; L is a sulfonyl group, n is 0, 1, 2 or 3; when n is 2 or 3, Y is a single bond, —N($R_1$)—, an oxygen atom, a sulfur atom, a selenium atom, or —($R_2$)C=C($R_3$)—, and when n is 0 or 1, Y is —N($R_1$)—, an oxygen atom, a sulfur atom, a selenium atom, or —($R_2$)C=C($R_3$)—, in which $R_1$, $R_2$ and $R_3$ are each a hydrogen or a substituent group; R is a hydrogen atom, a halogen atom or an aliphatic group, or R combines with $R_1$ or $R_3$ to form an alicyclic ring.

2. The photothermographic material of claim 1, wherein in formula (1), R is an alkyl group.

3. The photothermographic material of claim 1, wherein in formula (1), $R_1$, $R_2$ and $R_3$ are each —N($R_1$)—, an oxygen atom or a vinyl group and when Y is —N($R_1$)—, $R_1$ is an alkyl group.

4. The photothermographic material of claim 1, wherein in formula (1), n is 1 or 2.

5. The photothermographic material of claim 1, wherein in formula (1) , the halogen atom represented by $X_1$, $X_2$ and $X_3$ is chlorine or iodine.

6. The photothermographic material of claim 1, wherein in formula (1), $X_1$, $x_2$ and $X_3$ are each a halogen atom.

7. The photothermographic material of claim 6, wherein $X_1$, $X_2$ and $X_3$ are each bromine.

8. The photothermographic material of claim 1, wherein the formula (1), $R_1$, $R_2$ and $R_3$ are each —N($R_1$)—, an oxygen atom or a vinyl group and when Y is —N($R_1$)—, $R_1$ is an alkyl group, n is 1 or 2, and $X_1$, $X_2$ and $X_3$ are each a halogen atom.

9. The photothermographic material of claim 1, wherein the compound represented by formula (1), 6-aryl-2,4-bis(tribromomethyl)-s-triazine or a 6-heteroaryl-2,4-bis(tribromomethyl)-s-triazine is contained in an amount of $10^{-5}$ to 1 mol per mol of the total silver content of the silver halide and organic silver salt.

10. The photothermographic material of claim 1, wherein 6-aryl-2,4-bis(tribromomethyl)-s-triazine has an absorption maximum at a wavelength of 250 to 370 nm.

11. The photothermographic material of claim 1, wherein in formula (1), n is 0 or 1, Y is —N($R_1$)—, an oxygen atom, a sulfur atom, a selenium atom or —($R_2$)C=C($R_3$)—.

12. The photothermographic material of claim 1, wherein the photothermographic material comprises a light-sensitive layer, the light-sensitive layer containing an isocyanate compound of 0.5 to 5% by weight, based on the light-sensitive layer.

13. A photothermographic material comprising on a support a) an organic silver salt, b) a light-sensitive silver halide, c) a reducing agent, d) a compound represented by formula (1), 6-aryl-2,4-bis(tribromomethyl)-s-triazine or 6-heteroaryl-2,4-bis(tribromomethyl)-s-triazine, and e) an isocyanate compound:

formula (1)

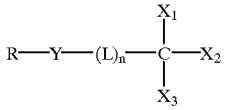

wherein $X_1$, $X_2$ and $X_3$ are each a hydrogen atom or a substituent group, provided that at least one of $X_1$, $X_2$ and $X_3$ is a halogen atom; L represents a sulfonyl group, a carbonyl group or a sulfinyl group; when L is a carbonyl group or sulfinyl group, n is 1, 2 or 3 and when L is a sulfonyl group, n is 0, 1, 2 or 3; when L is a carbonyl group or a sulfinyl group, Y is a single bond, —N($R_1$)—, an oxygen atom, a sulfur atom, a selenium atom, or —($R_2$)C=C($R_3$)—, when n is 2 or 3 and L is a sulfonyl group, Y is a single bond, —N($R_1$)—, an oxygen atom, a sulfur atom, a selenium atom, or —($R_2$)C=C($R_3$)—, and when n is 0 or 1 and L is a sulfonyl group, Y is —N($R_1$)—, an oxygen atom, a sulfur atom, a selenium atom, or —($R_2$)C=C($R_3$)—, in which $R_1$, $R_2$ and $R_3$ are each a hydrogen or a substituent group; R is a hydrogen atom, a halogen atom, an aliphatic group, or R combines with $R_1$ or $R_3$ to form an alicyclic ring.

14. The photothermographic material of claim 13, wherein the photothermographic material comprises a light-sensitive layer, the light-sensitive layer containing the isocyanate compound of 0.01 to 20% by weight, based on the light-sensitive layer.

15. The photothermographic material of claim 13, wherein the isocyanate compound is a compound represented by the following formula (2):

formula (2)

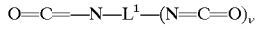

wherein v is an integer of 0 to 10; $L^1$ is an alkylene group, an alkenylene group, an arylenes group, an alkylarylene group or an isocyanuric acid residue.

16. The photothermographic material of claim 13, wherein the isocyanate compound is an aliphatic polyisocyanate.

17. The photothermographic material of claim 13, wherein the compound represented by formula (1) is represented by formula (1a), (1b), or (1c):

formula (1a)

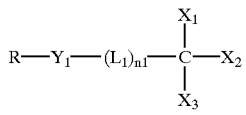

wherein $X_1$, $X_2$ and $X_3$ are each a hydrogen atom or a substituent group, provided that at least one of $X_1$, $X_2$ and $X_3$ is a halogen atom; $L_1$ represents a sulfonyl group, n1 is 0 or 1; $Y_1$ represents —N($R_1$)—, an oxygen atom, a sulfur atom, a selenium atom, or —$(R_2)C{=}C(R_3)$—, in which $R_1$, $R_2$ and $R_3$ each represent a hydrogen or a substituent group; R represents a hydrogen atom, a halogen atom, a substituted or unsubstituted aliphatic group, or R combines with $R_1$ or $R_3$ to form an alicyclic ring;

formula (1b)

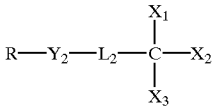

where $X_1$, $X_2$ and $X_3$ are each a hydrogen atom or a substituent group, provided that at least one of $X_1$, $X_2$ and $X_3$ is a halogen atom; $L_2$ represents a carbonyl group or a sulfinyl group; $Y_2$ represents —N(R)—, an oxygen atom, a sulfur atom, a selenium atom, or —$(R_2)C{=}C(R_3)$—, in which $R_1$, $R_2$ and $R_3$ each represent a hydrogen or a substituent group; R represents a hydrogen atom, a halogen atom, a substituted or unsubstituted aliphatic group, or R combines with $R_1$ or $R_3$ to form an alicyclic ring;

formula (1c)

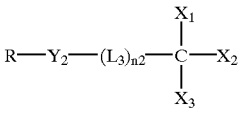

wherein $X_1$, $X_2$ and $X_3$ are each a hydrogen atom or a substituent group, provided that at least one of $X_1$, $X_2$ and $X_3$ is a halogen atom; $L_3$ represents a sulfonyl, a carbonyl group or a sulfinyl group; n2 is 2 or 3; $Y_2$ represents a single bond, —$R(R_1)$—, an oxygen atom, a sulfur atom, a selenium atom, or —$(R_2)C{=}C(R_3)$—, in which $R_1$, $R_2$ and $R_3$ each represent a hydrogen or a substituent group; R represents a hydrogen atom, a halogen atom, a substituted or unsubstituted aliphatic group, or R combines with $R_1$ or $R_3$ to form an alicyclic ring.

* * * * *